US010025216B2

(12) United States Patent
Uematsu et al.

(10) Patent No.: US 10,025,216 B2
(45) Date of Patent: Jul. 17, 2018

(54) CHARGING MEMBER WITH ELECTRO-CONDUCTIVE ELASTIC LAYER HAVING EXPOSED BOWL-SHAPED RESIN PARTICLES, PROCESS CARTRIDGE AND ELECTROPHOTOGRAPHIC APPARATUS

(71) Applicant: CANON KABUSHIKI KAISHA, Tokyo (JP)

(72) Inventors: Atsushi Uematsu, Fuji (JP); Tomohito Taniguchi, Suntou-gun (JP); Masahiro Watanabe, Mishima (JP); Noboru Miyagawa, Suntou-gun (JP); Taichi Sato, Numazu (JP); Takehiko Aoyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/546,826

(22) PCT Filed: Mar. 30, 2016

(86) PCT No.: PCT/JP2016/061187
§ 371 (c)(1),
(2) Date: Jul. 27, 2017

(87) PCT Pub. No.: WO2016/159387
PCT Pub. Date: Oct. 6, 2016

(65) Prior Publication Data

US 2018/0024460 A1 Jan. 25, 2018

(30) Foreign Application Priority Data

Apr. 3, 2015 (JP) ..... 2015-077053

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
(Continued)

(56) References Cited

U.S. PATENT DOCUMENTS 7,727,134 B2 6/2010 Nakamura et al.
8,383,234 B2 2/2013 Mayuzumi et al.
(Continued)

FOREIGN PATENT DOCUMENTS

JP 2008-276026 11/2008
JP 2011-237470 11/2011
JP 2012-103414 5/2012

*Primary Examiner* — William J Royer
(74) *Attorney, Agent, or Firm* — Fitzpatrick Cella Harper and Scinto

(57) ABSTRACT

Provided is a charging member capable of suppressing the occurrence of an image defect due to the non-uniform abrasion of a photosensitive member and a stain, in a long-term use.
The charging member includes an electro-conductive elastic layer as a surface layer.
The electro-conductive elastic layer contains a binder and a bowl-shaped resin particle having an opening. The surface of the charging member has a concavity and a protrusion derived from the bowl-shaped resin particle. The relations represented by the following formulae are satisfied, $$0.2 \le S = \frac{|S5 - S1|}{S1} \le 0.5$$

$$0.15 \le d = \frac{|d5 - d1|}{d1} \le 0.5$$

wherein, when the charging member is pressed onto a glass plate with 100 (g) load, S1 is the average value of contact areas, d1 is the average value of heights of spaces formed in
(Continued)

a contact region; and when the load is changed to 500 (g), S5 is the average value of contact areas, d5 is the average value of heights of spaces.

6 Claims, 5 Drawing Sheets

(58) Field of Classification Search
USPC ..... 399/176
See application file for complete search history.

(56) References Cited

U.S. PATENT DOCUMENTS 8,532,534 B2 * 9/2013 Taniguchi et al. . G03G 15/0233 399/176
8,538,298 B2 9/2013 Harada et al.
8,548,359 B2 10/2013 Taniguchi et al.
8,550,969 B2 10/2013 Taniguchi et al.
8,628,854 B2 1/2014 Yamauchi et al.
8,745,870 B2 6/2014 Kawamura et al.
8,771,818 B2 7/2014 Nishioka et al.
8,852,743 B2 10/2014 Kikuchi et al.
8,971,766 B2 3/2015 Taniguchi et al.
9,075,333 B2 7/2015 Uematsu et al.
9,098,006 B2 8/2015 Uematsu et al.
9,146,482 B2 9/2015 Watanabe et al.
9,158,213 B2 10/2015 Taniguchi et al.
9,256,153 B2 2/2016 Aoyama et al.
9,268,243 B2 2/2016 Aoyama et al.
9,274,442 B2 3/2016 Sato et al.
9,274,496 B2 3/2016 Miyagawa et al.
9,291,936 B2 * 3/2016 Taniguchi et al. . G03G 15/0233
9,304,429 B2 * 4/2016 Miyagawa et al. ..... G03G 15/0233
9,411,307 B2 8/2016 Matsuda et al.
9,448,502 B2 9/2016 Taniguchi et al.
9,541,854 B2 1/2017 Kikuchi et al.
9,599,913 B2 3/2017 Nishioka et al.
9,599,914 B2 3/2017 Uematsu et al.
9,632,446 B2 4/2017 Matsuda et al.
9,645,517 B2 5/2017 Sato et al.
9,678,452 B2 * 6/2017 Watanabe et al. . G03G 15/0233
2011/0305481 A1 12/2011 Taniguchi et al.
2012/0076539 A1 3/2012 Sato et al.
2013/0223886 A1 8/2013 Miyagawa et al.
2013/0236214 A1 9/2013 Koide et al.
2013/0251403 A1 9/2013 Matsuda et al.
2013/0281276 A1 10/2013 Watanabe et al.
2014/0221183 A1 8/2014 Miyagawa et al.
2014/0301754 A1 10/2014 Uematsu et al.

* cited by examiner

PRIOR ART

CHARGING MEMBER WITH ELECTRO-CONDUCTIVE ELASTIC LAYER HAVING EXPOSED BOWL-SHAPED RESIN PARTICLES, PROCESS CARTRIDGE AND ELECTROPHOTOGRAPHIC APPARATUS

TECHNICAL FIELD

The present invention relates to a charging member to charge the surface of an electrophotographic photosensitive member as a member to be charged to a predetermined electrical potential by applying a voltage, and a process cartridge and an electrophotographic image-forming apparatus (hereinafter, referred to as an "electrophotographic apparatus") using the same.

BACKGROUND ART

An electrophotographic apparatus employing an electrophotographic method primarily includes an electrophotographic photosensitive member (hereinafter, also simply referred to as "photosensitive member"), a charging member, an exposing device, a developing device, a transfer device and a fixing device. As the charging device, a contact charging member which charges the surface of a photosensitive member by applying a voltage (a voltage of a DC voltage only or a voltage of the DC voltage superimposed with an AC voltage) to the charging member brought into contact with or closely disposed on the surface of the photosensitive member is commonly employed.

In order to stabilize the charging of a photosensitive member induced by contact charging, Patent Literature 1 (PTL 1) discloses a charging member for contact charging including a surface layer having a protrusion derived from a resin particle or the like on the surface. By using such a charging member, the charging of the photosensitive member is stabilized. However, when the charging member described in Patent Literature 1 comes into contact with the photosensitive member, the contact pressure concentrates on the protrusion derived from the resin particle on the surface of the charging member (charging roller), and as a result, non-uniform abrasion occurs on the surface of the photosensitive member in a long-term use, which may cause a vertically streaked image defect due to the non-uniform abrasion.

To address this problem, Patent Literature 2 (PTL 2) proposes a charging member including an electro-conductive resin layer containing a bowl-shaped resin particle having an opening, wherein the charging member has an uneven shape derived from the opening and edge of the bowl-shaped resin particle on the surface of the charging member. By using the charging member described in Patent Literature 2, the contact pressure on a photosensitive member is relaxed by deforming the edge of the opening of the bowl-shaped resin particle (hereinafter, also simply referred to as "edge") on the surface of the charging member. For the above reason, the non-uniform abrasion of the photosensitive member can be suppressed even in a long-term use.

CITATION LIST

Patent Literature

PTL 1: Japanese Patent Application Laid-Open No. 2008-276026

PTL 2: Japanese Patent Application Laid-Open No. 2011-237470

SUMMARY OF INVENTION

Technical Problem

However, along with the recent increase of the speed and durability of electrophotography, it has been required not only to suppress the non-uniform abrasion of a photosensitive member, but also to further enhance the stain resistance. Although the charging member described in Patent Literature 2 can suppress the non-uniform abrasion of a photosensitive member, the stain resistance is not necessarily sufficient; In general, a stain on a charging member occurs owing to the following phenomenon. A toner component remaining on a photosensitive member even after a transferring process (hereinafter, also referred to as "residual toner") should be normally removed with a cleaning blade or the like in a cleaning process. However, as a result of the vibration of a cleaning blade or on the occurrence of a tiny scratch, the residual toner may slip by the cleaning blade and remain on the photosensitive member even after the cleaning process. The toner comes into contact with the charging member to cause a stain on the charging member.

According to an investigation by the present inventors, the charging member proposed in Patent Literature 2 provides an effect of reducing the amount of a toner to slip by a cleaning blade, whereby the charging member is less likely to cause a scratch on a photosensitive member and enables to control the vibration of a cleaning blade to some extent owing to the enhanced followability to a photosensitive member. However, although the amount of a toner to slip is reduced, residual toners are gradually deposited to accumulate on the charging member due to a long-term use, which may cause a stain on the charging member.

Particularly, owing to a high fluidity of a toner under a low temperature and low humidity environment, the slipping of the toner is promoted, and a stain on a charging member which leads an image defect tends to become obvious. For this reason, dotted and horizontally streaked images due to the stain deposited to accumulate may occur. According to a further investigation by the present inventors, the reason for the charging member proposed in Patent Literature 2 to get stained is thought to be that the contact area of the edge increases in a nip portion between the charging member and the photosensitive member to allow a stain to easily adhere to the contact portion.

The mechanism for the occurrence of an adhered stain as described above will be described using FIGS. 2A and 2B below. As illustrated in FIG. 2A, the edge of a bowl-shaped resin particle contacting with a photosensitive member 13 in a nip portion warps to the arrow A directions, and as a result the bowl-shaped resin particle is elastically deformed so as to increase the contact area between the photosensitive member 13 and the edge, as illustrated in FIG. 2B. The present inventors think that the adhesion of a stain is caused by this. In the present specification, a nip is defined as a region sandwiched between two lines parallel in the longitudinal direction of a charging member each of which passes through one of both end points of contact points between the charging member and a photosensitive member in the direction perpendicular to the longitudinal direction of the charging member.

As a method for suppressing dotted and horizontally streaked images due to the adhesion of a stain caused by the above increase of the contact area between the photosensitive member 13 and the edge, a method is contemplated in which the hardness of an electro-conductive elastic layer 12 around the edge is increased over the whole region to suppress the warp of the edge to the arrow A directions. However, in this case, the warp of the edge can be suppressed but the contact pressure cannot be relaxed. Therefore, the contact pressure is concentrated on the contact point between the photosensitive member 13 and the edge, and the non-uniform abrasion of the photosensitive member occurs in a long-term use. Accordingly, the present inventors have recognized that suppressing the adhesion of a stain and the non-uniform abrasion of a photosensitive member 13 simultaneously is a problem to be solved in order to address the increase of the speed and durability of electrophotography.

Accordingly, the present invention is directed to providing a charging member which suppresses the non-uniform abrasion of a photosensitive member even in a long-term use and suppresses the adhesion of a stain on the surface of the charging member to suppress the occurrence of a vertically streaked image due to the non-uniform abrasion of a photosensitive member and dotted and horizontally streaked images due to the adhesion of a stain.

In addition, the present invention is directed to providing a process cartridge and an electrophotographic apparatus which contribute to forming a high-quality electrophotographic image.

Solution to Problem

According to one aspect of the present invention, there is provided a charging member including: an electro-conductive substrate; and an electro-conductive elastic layer as a surface layer on the substrate, wherein the electro-conductive elastic layer contains a binder, and retains a bowl-shaped resin particle having an opening, so that the opening of the bowl-shaped resin particle is exposed at the surface of the charging member; the surface of the charging member has: a concavity derived from the opening of the bowl-shaped resin particle exposed at the surface, and a protrusion derived from an edge of the opening of the bowl-shaped resin particle exposed at the surface; a part of the surface of the charging member is constituted by the electro-conductive elastic layer; and relations represented by the following formulae (1) and (2) are satisfied.

$$0.2 \le S = \frac{|S5 - S1|}{S1} \le 0.5 \qquad \text{Formula (1)}$$

$$0.15 \le d = \frac{|d5 - d1|}{d1} \le 0.5 \qquad \text{Formula (2)}$$

In the formulae (1) and (2), when the charging member is pressed onto a glass plate so that a load on the glass plate is 100 (g), in a contact region R1 including at least one contact portion between the charging member and the glass plate in a nip between the charging member and the glass plate, S1 is defined as an average value of contact areas between the charging member and the glass plate in the respective contact portions and d1 is defined as an average value of heights of respective spaces formed between the charging member and the glass plate in the contact region R1; and when the charging member is pressed onto a glass plate so that a load on the glass plate is 500 (g), in a contact region R5 including at least one contact portion between the charging member and the glass plate in a nip between the charging member and the glass plate, S5 is defined as an average value of contact areas between the charging member and the glass plate in the respective contact portions and d5 is defined as an average value of heights of respective spaces formed between the charging member and the glass plate in the contact region R5.

Further, according to another aspect of the present invention, there is provided a process cartridge, including the above charging member and an electrophotographic photosensitive member and being configured to be attachable to and detachable from the main body of an electrophotographic apparatus.

Furthermore, according to another aspect of the present invention, there is provided an electrophotographic apparatus including the above charging member and an electrophotographic photosensitive member.

Advantageous Effects of Invention

According to one aspect of the present invention, there is provided a charging member which suppresses the non-uniform abrasion of a photosensitive member even in a long-term use and suppresses the adhesion of a stain on the surface of the charging member to suppress the occurrence of a vertically streaked image due to the non-uniform abrasion of a photosensitive member and dotted and horizontally streaked images due to the adhesion of a stain. In addition, according to another aspect of the present invention, there are provided a process cartridge and the electrophotographic apparatus which contribute to forming a high-quality electrophotographic image.

Further features of the present invention will become apparent from the following description of exemplary embodiments with reference to the attached drawings.

DESCRIPTION OF EMBODIMENTS

Figure 1A:
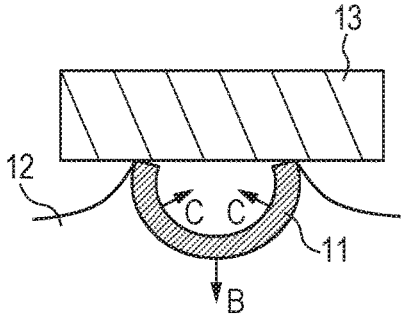
FIG. 1A is a diagram illustrating the deformation of a bowl-shaped resin particle.

Preferred embodiments of the present invention will now be described in detail in accordance with the accompanying drawings.

The charging member according to the present invention (hereinafter, referred to as "the charging member") is a charging member including an electro-conductive substrate and an electro-conductive elastic layer as a surface layer on the substrate. The electro-conductive elastic layer contains a bowl-shaped resin particle having an opening, and a binder. The electro-conductive elastic layer retains the bowl-shaped resin particle so that the opening of the bowl-shaped resin particle is exposed at the surface of the charging member. The surface of the charging member has a concavity derived from the opening of the bowl-shaped resin particle exposed at the surface (hereinafter, sometimes simply referred to as "concavity of the bowl") and a protrusion derived from the edge of the opening of the bowl-shaped resin particle (hereinafter, sometimes simply referred to as "edge of the bowl") exposed at the surface (hereinafter, sometimes simply referred to as "protrusion of the bowl"). In addition, a part of the surface of the charging member is constituted by the electro-conductive elastic layer.

The charging member satisfies the relation represented by the formula (1).

$$0.2 \le S = \frac{|S5 - S1|}{S1} \le 0.5 \qquad \text{Formula (1)}$$

Regarding "S1", when the charging member is pressed onto a glass plate so that the load on the glass plate is 100 (g), in a contact region R1 including at least one contact portion between the charging member and the glass plate in a nip between the charging member and the glass plate, "S1" is defined as an average value of contact areas between the charging member and the glass plate in the respective contact portions. Regarding "S5", when the charging member is pressed onto a glass plate so that the load on the glass plate is 500 (g), in a contact region R5 including at least one contact portion between the charging member and the glass plate in a nip between the charging member and the glass plate, "S5" is defined as an average value of contact areas between the charging member and the glass plate in the respective contact portions. "Nip" is a contact portion between the charging member and the glass plate, and more specifically a region sandwiched between two lines parallel in the longitudinal direction of the charging member each of which passes through one of both end points of contact points, between the charging member and the glass plate in the direction perpendicular to the longitudinal direction of the charging member.

Here, in the case that one contact portion is included in the contact region R1, the contact area of the contact portion is S1. Similarly; in the case that one contact portion is included in the contact region R5, the contact area is S5.

The contact region R1 and the contact region R5 are each a region set so as to include at least one contact portion between the charging member and the glass plate in a nip. The contact region R1 and the contact region R5 may be different or the same. However, from the viewpoint of the number of steps and precision of measurement for the contact area, the contact region R1 and the contact region R5 are preferably the same region.

Further, the charging member satisfies the relation represented by the formula (2).

$$0.15 \le d = \frac{|d5 - d1|}{d1} \le 0.5 \qquad \text{Formula (2)}$$

d1 is defined as an average value of heights of a plurality of spaces formed between the charging member and the glass plate in the contact region R1. d5 is defined as an average value of heights of a plurality of spaces formed between the charging member and the glass plate in the contact region R5. These spaces are formed not only at a concavity of the bowl but also between adjacent bowls. The reference sign 85 in FIG. 9B indicates a space formed between the charging member and the glass plate when the charging member is pressed onto the glass plate with a load of 100 (g). The distance d' denotes the height of the space, i.e., the distance between the most distant position from the glass surface in the space and the glass surface.

Figure 1B:
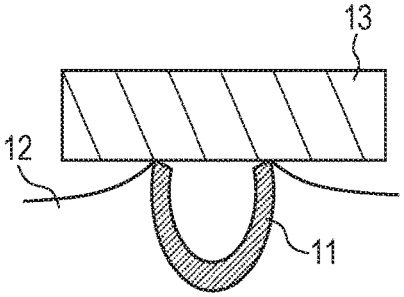
FIG. 1B is a diagram illustrating the deformation of a bowl-shaped resin particle.
Figure 1C:
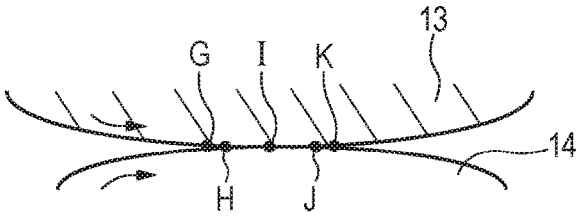
FIG. 1C is a diagram illustrating a relation between contact positions and loads in a nip portion of one example of a charging member according to the present invention.

As illustrated in FIG. 1C, the contact state between a charging member 14 and a photosensitive member 13 is changed from immediately after the entry of the nip portion (position H) through at the center of the nip portion (position I) to immediately before release from the contact (position J). In this case, the load at the position I differs from the load at the positions H and J. While it is thought that almost no load is applied at the position being about to enter the nip (position G) and the position immediately after release from the contact (position K), the change in load in the range from H to J in a common electrophotographic apparatus is expected to be within five times. This can be expected from a load distribution in a nip when the charging member 14 is brought into contact with the photosensitive member 13. When the present inventors determined the load distribution for a common electrophotographic apparatus, the load distribution was found to be within five times, from which the present inventors considered the change in load in passing through a nip to be within five times. Accordingly, the change in contact state between the charging member 14 and the photosensitive member 13 over the range of H to J can be evaluated in a simulative manner by measuring the ratio of the case of changing the load to five times the load. And in order to carry out the above evaluation for the contact state more accurately, and in view of the fact that a common electrophotographic apparatus has a lower limit load of 100 g, the present inventors determined that 100 g can be used as the lower limit load. Therefore, in the present invention, the above evaluation for the contact state was carried out using 100 g and 500 g, which is five times as large as 100 g, as the contact load.

The ratio S of contact area between the above two contact loads represented in the formula (1) is a value which indicates the extent to which, when the contact load is changed from 100 g to 500 g, the protrusion derived from the edge of the bowl can maintain the point contact state with the photosensitive member. That is, this ratio of S is an indicator for evaluating the ability of the charging member to maintain the point contact state with a photosensitive member in the nip portion of the charging member. Specifically, in the case that the value of the ratio S is small, the ability to maintain the point contact state is high, and in the case that the value of the ratio S is large, the opposite is applied.

Figure 2A:
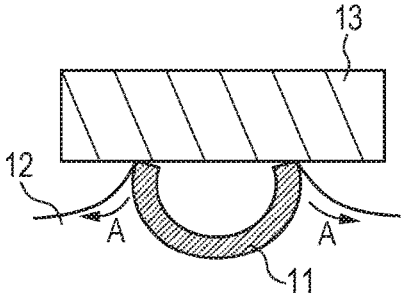
FIG. 2A is a diagram illustrating the deformation of a bowl-shaped resin particle in a nip portion of a conventional charging member.
Figure 2B:
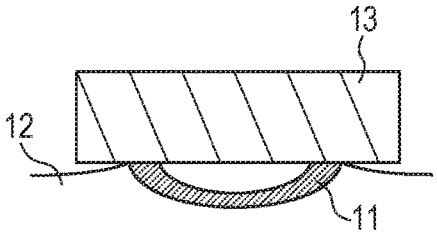
PRIOR ART FIG. 2B
FIG. 2B is a diagram illustrating the deformation of a bowl-shaped resin particle in a nip portion of the conventional charging member.

Since the load applied on the surface of the charging member 14 increases from the position H immediately after the entry of the nip portion to the position I at the center of the nip portion in FIG. 1C, regarding a bowl-shaped resin particle 11, the edge of the bowl warps to the arrow A directions as illustrated in FIG. 2A. And in the case that the charging member 14 has a low ability to maintain the point contact state, the contact area between the photosensitive member 13 and the edge of the bowl becomes to be an increased state as illustrated in FIG. 2B. In such a case, the adhesion of a stain is likely to occur on the surface of the charging member 14.

In the charging member, the ratio S of contact area between two contact loads satisfies the range represented by the formula (1). In the case that the ratio S is 0.5 or less ($S \leq 0.5$), the charging member has a high ability to maintain the point contact state with the surface of the photosensitive member, as described above. Therefore, the adhesion of a stain at the contact portion can be suppressed, as described above. In this configuration in which a binder and a bowl-shaped resin particle are contained in the electro-conductive elastic layer, the reason why the lower limit of the ratio S is set to 0.2 is that no method could be found out to set the ratio S to less than 0.2 using a material and a production method which can be used in a practical way. The ratio S is 0.2 or more and 0.5 or less, and preferably 0.2 or more and 0.3 or less. The ratio S within this range enables the charging member to exhibit a higher ability to maintain the point contact state and further enhance the effect to suppress the adhesion of a stain.

The ratio d of height of spaces between the above two contact loads represented in the formula (2) is an indicator of how much space can be maintained between the surface of the charging member and the photosensitive member when the contact load is changed from 100 g to 500 g. Specifically, in the case that the value of the ratio d is small, the ability to maintain the space is high, and in the case that the value of the ratio d is large, the opposite is applied. And due to the above ratio d, the deformation state of the bowl-shaped resin particle in the nip portion between the charging member and the photosensitive member can be evaluated.

In the meanwhile, the charging member has a high ability to maintain the point contact state, as described with the formula (1). That is, satisfying the formula (1) enables to suppress the movement which changes the shape of the bowl-shaped resin particle 11 from the state in FIG. 2A to the state in FIG. 2B. It is believed that the bowl-shaped resin particle on the surface of the charging member satisfying the above conditions and having a high ability to maintain the point contact state behaves as described below in the nip portion.

In FIG. 1C, the load applied on the surface of the charging member 14 increases as proceeding from the position H immediately after the entry of the nip portion to the position I at the center of the nip portion. In the case that the surface of the charging member 14 has a high ability to maintain the point contact state, the edge of the bowl-shaped resin particle 11 surrounded by the electro-conductive elastic layer 12 warps to the arrow C directions as illustrated in FIG. 1A. Thus, the bowl-shaped resin particle 11 itself sinks down into the arrow B direction, i.e., the inward direction of the electro-conductive elastic layer 12. That is, in the case that the value of the ratio d is small, it is believed that the shape is as illustrated in FIG. 1B at the position I at the center of the nip portion. By the above contacting, the bowl-shaped resin particle 11 itself whose edge is applied with a load sinks down into the inward direction of the electro-conductive elastic layer 12, thereby, the contact pressure can be relaxed, and the non-uniform abrasion of the photosensitive member 13 can be suppressed.

On the other hand, the case that the surface of the charging member has a too high ability to maintain the space, i.e., the case that the value of the ratio d is less than 0.15 means that the bowl-shaped resin particle is substantially not elastically deformed. In this case, relaxation of the contact pressure caused by the bowl-shaped resin particle is less likely to occur, whereby, the above-described non-uniform abrasion of the photosensitive member may occur.

In the charging member, the ratio d satisfies the range represented by the formula (2). In the case that the ratio d is 0.5 or less ($d \leq 0.5$), the charging member has a high ability to maintain the space between the charging member and the surface of the photosensitive member, whereby, the adhesion of a stain on the contact portion can be suppressed, as described above. In the case that the ratio d is 0.15 or more ($0.15 \leq d$), the bowl-shaped resin particle can be elastically deformed, whereby, the contact pressure on the photosensitive member can be relaxed and as a result the above-described non-uniform abrasion of the photosensitive member can be suppressed. The ratio d is 0.15 or more and 0.5 or less, and preferably 0.4 or more and 0.5 or less. The ratio d within this range enables the charging member to exhibit a higher effect with respect to the ability to maintain the space at the contact portion with the photosensitive member and relaxation of the contact pressure on the photosensitive member.

As described above, the charging member satisfying the formulae (1) and (2) can maintain the point contact state with a photosensitive member and can maintain the space, and in addition can relax the contact pressure at the protrusion derived from the edge of the bowl. Therefore, the adhesion of a stain on the surface of the charging member and the non-uniform abrasion of a photosensitive member can be suppressed simultaneously.

In order to ensure that the ratios of S and d are within, the range of the formulae (1) and (2), respectively, when the Martens hardness of the binder on the surface of the charging member (electro-conductive elastic layer 72) (F in FIG.

Figure 8:
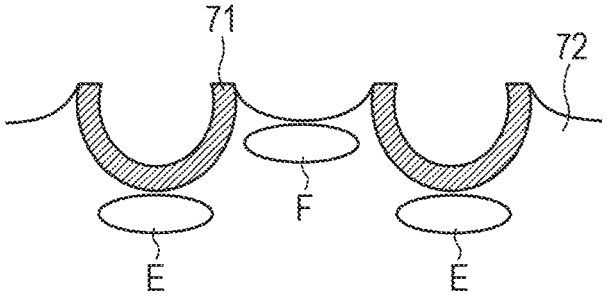
FIG. 8 is a diagram illustrating positions for hardness measurement at the surface of a charging member.

8) is defined as M1 and the Martens hardness of the binder immediately beneath the bottom of the concavity derived from the opening of the bowl-shaped resin particle 71 on the surface of the charging member (E in FIG. 8, hereinafter also referred to as "binder immediately beneath the concavity of the bowl") is defined as M2, the value of "M2/M1" is preferably less than 1. Further, the value of "M2/M1" is more preferably 0.7 or less.

In order to set the values M1 and M2 in the above range, a method can be used in which the surface of the charging member is oxidatively cured by heat treatment in the atmosphere using a material having a low oxygen permeability as the shell material for the bowl-shaped resin particle. This method will be described in detail later.

<Glass Plate>

In the present invention, a glass plate (material: BK7, surface accuracy: both sides optically grinded, parallelism: within 1', thickness: 2 mm) is used, for example.

<Charging Member>

Figure 3A:
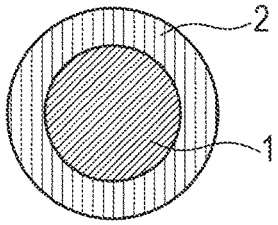
FIG. 3A is a schematic cross-sectional view illustrating one example of the charging member according to the present invention.
Figure 3B:
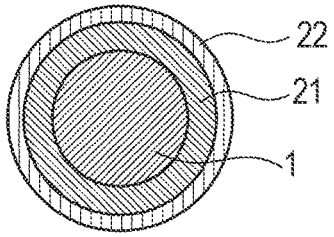
FIG. 3B is a schematic cross-sectional view illustrating one example of the charging member according to the present invention.

Schematic diagrams of a cross-section of one example of the charging member are illustrated in FIGS. 3A and 3B. The charging member in FIG. 3A includes an electro-conductive substrate 1 and an electro-conductive elastic layer 2. The electro-conductive elastic layer may have a two-layer configuration having electro-conductive elastic layers 21 and 22, as illustrated in FIG. 3B.

The electro-conductive substrate 1 and electro-conductive elastic layer 2 or layers which are sequentially layered on the electro-conductive substrate 1 (e.g., the electro-conductive elastic layers 21 and 22 illustrated in FIG. 3B) may be bonded together via an adhesive. In this case, the adhesive can be electro-conductive. A know electro-conductive adhesive can be used.

Examples of the adhesive base include thermosetting resins and thermoplastic resins, and a known resin can be used such as a urethane, acrylic, polyester, polyether and epoxy resin. As an electro-conductive agent to impart electro-conductivity to an adhesive, one of appropriately selected electro-conductive fine particles described detail later can be used singly, or two or more thereof can be used in combination.

[Electro-Conductive Substrate]

An electro-conductive substrate has electro-conductivity and has a function to support an electro-conductive elastic layer to be provided thereon. Examples of the material of an electro-conductive substrate include metals such as iron, copper, aluminum and nickel, and alloys thereof (such as a stainless steel).

[Electro-Conductive Elastic Layer]

Figure 5A:
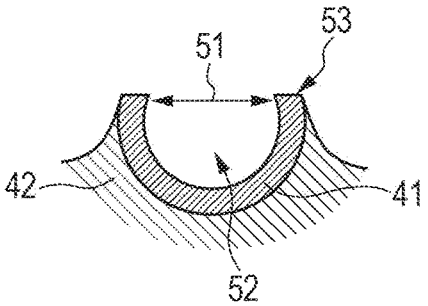
FIG. 5A is a partial cross-sectional view in the vicinity of the surface of one example of the charging member according to the present invention.
Figure 5B:
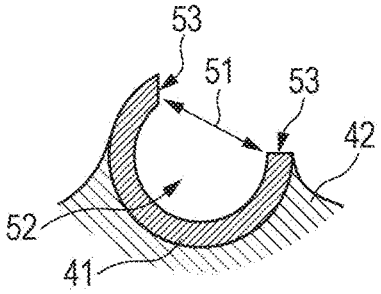
FIG. 5B is a partial cross-sectional view in the vicinity of the surface of one example of the charging member according to the present invention.

FIGS. 5A and 5B are each a partial cross-sectional view in the vicinity of the surface of an electro-conductive elastic layer included in the surface layer of the charging member. A part of bowl-shaped resin particles contained in the electro-conductive elastic layer is exposed at the surface of the charging member. And the surface of the charging member is constituted by a concavity 52 derived from an opening 51 of a bowl-shaped resin particle 41 exposed at the surface, a protrusion derived from an edge 53 of the opening 51 of the bowl-shaped resin particle 41 exposed at the surface, and the electro-conductive elastic layer 42 around the bowl-shaped resin particle 41 exposed at the surface. The edge 53 can have a form illustrated in FIGS. 5A and 5B, for example.

Figure 6:
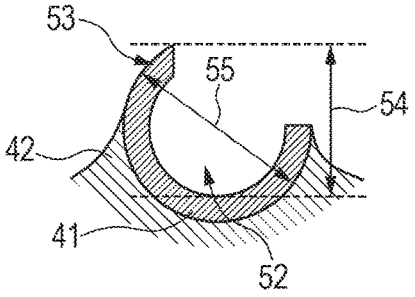
FIG. 6 is a partial cross-sectional view in the vicinity of the surface of one example of the charging member according to the present invention.

A height difference 54 between the top of the protrusion derived from the edge 53 of the opening 51 of the bowl-shaped resin particle 41 and the bottom of the concavity 52 defined by the shell of the same bowl-shaped resin particle 41 illustrated in FIG. 6 is preferably 5 μm or more and 100 μm or less, and particularly preferably 10 μm or more and 80 μm or less. The height difference within this range enables to maintain the point contact of the edge of the bowl in the nip portion more reliably. The ratio of a maximum diameter 55 of the bowl-shaped resin particle 41 to the height difference 54 between the top of the protrusion and the bottom of the concavity 52, i.e., [maximum diameter]/[height difference] of the resin particle is preferably 0.8 or more and 3.0 or less, and particularly preferably 1.1 or more and 1.6 or less. The value of [maximum diameter]/[height difference] of the resin particle within this range enables to maintain the point contact of the edge of the bowl in the nip portion more reliably. In the present invention, the "maximum diameter" of a bowl-shaped resin particle is defined as the maximum length in a circular projection image provided by the bowl-shaped resin particle. In the case that the bowl-shaped resin particle provides a plurality of circular projection images, the maximum value among the maximum lengths in the respective projection images is defined as the "maximum diameter" of the bowl-shaped resin particle.

The surface state of the electro-conductive elastic layer can be controlled as in the following by forming the uneven shape. The ten-point average surface roughness (Rzjis) is preferably 5 μm or more and 65 μm or less, and particularly preferably 10 μm or more and 50 μm or less. The average concave to convex distance (Sm) of the surface is preferably 30 μm or more and 200 μm or less, and particularly preferably 40 μm or more and 150 μm or less. By being within the above respective ranges, maintaining the point contact of the edge of the bowl in the nip portion can be more reliably. Methods for measuring the ten-point average roughness (Rzjis) of the surface and the average concave to convex distance (Sm) of the surface will be described in detail later.

Figure 7A:
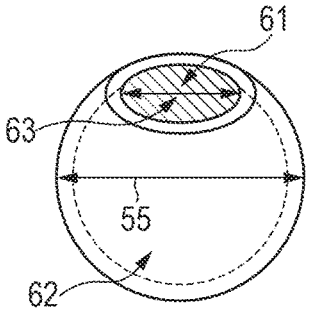
FIG. 7A is a diagram illustrating the shape of one example of the bowl-shaped resin particle according to the present invention.
Figure 7B:
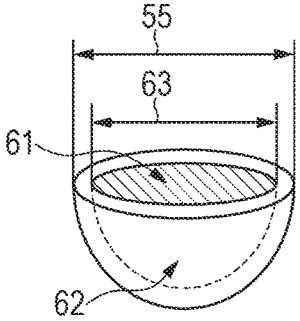
FIG. 7B is a diagram illustrating the shape of one example of the bowl-shaped resin particle according to the present invention.
Figure 7C:
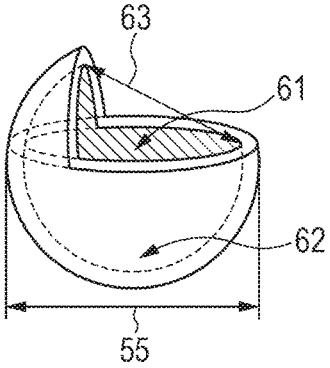
FIG. 7C is a diagram illustrating the shape of one example of the bowl-shaped resin particle according to the present invention.
Figure 7D:
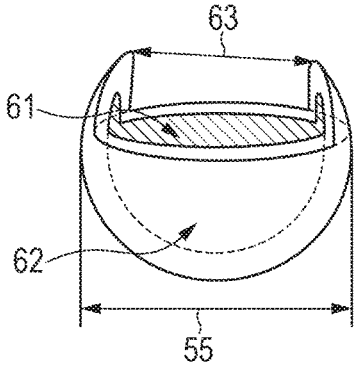
FIG. 7D is a diagram illustrating the shape of one example of the bowl-shaped resin particle according to the present invention.
Figure 7E:
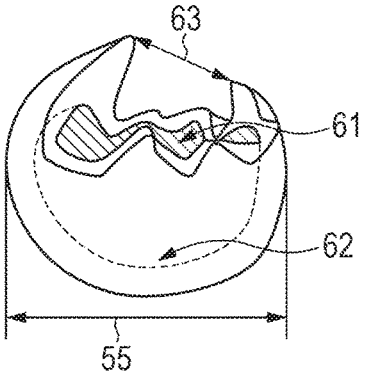
FIG. 7E is a diagram illustrating the shape of one example of the bowl-shaped resin particle according to the present invention.

Examples of the bowl-shaped resin particle are illustrated in FIGS. 7A to 7E. In the present invention, "bowl-shaped" refers to a shape having an opening portion 61 and a round concavity 62. In the "opening portion", the edge of the bowl may be flat as illustrated in FIGS. 7A and 7B, or the edge of the bowl may have unevenness as illustrated in FIGS. 7C to 7E.

The rough standard value for the maximum diameter 55 of the bowl-shaped resin particle is 10 μm or more and 150 μm or less, and particularly 20 μm or more and 100 μm or less. In addition, the ratio of the maximum diameter 55 of the bowl-shaped resin particle to a minimum diameter 63 of the opening portion, i.e., [maximum diameter]/[minimum diameter of opening portion] of the bowl-shaped resin particle is more preferably 1.1 or more and 4.0 or less. The ratio within this range enables the bowl-shaped resin particle to sink down into the inward direction of the electro-conductive elastic layer in the nip portion described later more reliably.

The thickness of the shell (the difference between the outer diameter and inner diameter of the periphery) around the opening portion of the bowl-shaped resin particle is preferably 0.1 μm or more and 3 μm or less, and particularly preferably 0.2 μm or more and 2 μm or less. The thickness within this range enables the bowl-shaped resin particle to sink down into the inward direction of the electro-conductive elastic layer in the nip portion described later. With regard to the above thickness of the shell, the "maximum, thickness" is preferably three times the "minimum thickness" or less, and more preferably twice the "minimum thickness" or less.

[Binder]

A known rubber or resin can be used for the binder contained in the electro-conductive elastic layer. Examples of the rubber include natural rubbers and vulcanized products thereof, and synthetic rubbers. Examples of the synthetic rubber are as follows. An ethylene-propylene rubber, a styrene-butadiene rubber (SBR), a silicone rubber, a urethane rubber, an isopropylene rubber (IR), a butyl rubber, an acrylonitrile-butadiene rubber (NBR), a chloroprene rubber (CR), a butadiene rubber (BR), an acrylic rubber, an epichlorohydrin rubber and a fluorine rubber. Examples of the resin which can be used include thermosetting resins and thermoplastic resins. Among them, a fluorine resin, a polyamide resin, an acrylic resin, a polyurethane resin, an acrylic urethane resin, a silicone resin and a butyral resin are more preferred. One of them may be used singly, or two or more thereof may be used in combination. Alternatively, monomers of some of these resins may be copolymerized into a copolymer.

[Electro-Conductive Fine Particle]

The rough standard value for the volume resistivity of the electro-conductive elastic layer can be $1\times10^{2}$ Ωcm or more and $1\times10^{16}$ Ωcm or less under an environment with a temperature of 23° C. and a relative humidity of 50%. The volume resistivity within this range facilitates to suitably charge the electrophotographic photosensitive member by discharge. For this purpose, a known electro-conductive fine particle may be contained in the electro-conductive elastic layer. Examples of the electro-conductive fine particle include particles of a metal oxide, a metal, carbon black and graphite. Further, one of these electro-conductive fine particles can be used singly, or two or more thereof can be used in combination. The rough standard value for the content of the electro-conductive fine particle in the electro-conductive elastic layer is 2 parts by mass or more and 200 parts by mass or less, and particularly 5 parts by mass or more and 100 parts by mass or less based on 100 parts by mass of the binder.

[Method for Forming Electro-Conductive Elastic Layer]

A method for forming the electro-conductive elastic layer will be illustrated in the following. First, a coating layer in which a hollow-shaped resin particle is dispersed in a binder is provided on an electro-conductive substrate. Thereafter, the hollow-shaped resin particle is partly removed into a bowl shape by grinding the surface of the coating layer to form a concavity derived from the opening of the bowl-shaped resin particle and a protrusion derived from the edge of the opening of the bowl-shaped resin particle (hereinafter, a shape having these concavity and protrusion is referred to as "uneven shape derived from the opening of the bowl-shaped resin particle"). An electro-conductive resin layer is formed in this way, and subsequently heat-treated for thermosetting. Among the coating layers, the coating layer before grinding is referred to as the "pre-coating layer".

[Dispersion of Resin Particle in Pre-Coating Layer]

First, methods for dispersing a hollow-shaped resin particle in the pre-coating layer will be described. One example of the method is a method in which a coating film of an electro-conductive resin composition in which a hollow-shaped resin particle containing a gas inside is dispersed in a binder is formed on a substrate, and the coating film is dried, and cured or crosslinked, or the like. Here, an electro-conductive particle can be contained in the electro-conductive resin composition. The material used for the hollow-shaped resin particle is preferably a resin having a polar group, and more preferably a resin having the unit represented by the following formula (4) from the viewpoint of having a low gas permeable and a high impact resilience. Particularly from the viewpoint of facilitating to control grinding properties, a resin having both of the unit represented by the formula (4) and the unit represented by the formula (8) is more preferred.

Formula (4)

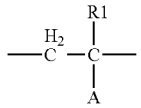

In the formula (4), A is at least one selected from the group consisting of the following formulae (5), (6) and (7); and R1 is a hydrogen atom or an alkyl group having 1 to 4 carbon atoms.

Formula (5)

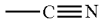

Formula (6)

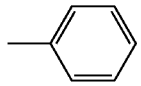

Formula (7)

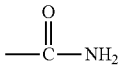

Formula (8)

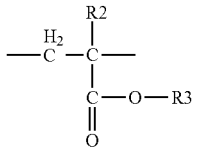

In the formula (8), R2 is a hydrogen atom or an alkyl group having 1 to 4 carbon atoms; and R3 is a hydrogen atom or an alkyl group having 1 to 10 carbon atoms.

Another example of the method is a method of using a thermally expandable microcapsule containing an included substance inside of the particle, and the included substance is expanded by heating, and whereby the thermally expandable microcapsule becomes a hollow-shaped resin particle. In this method, an electro-conductive resin composition in which a thermally expandable microcapsule is dispersed in a binder is produced, with which an electro-conductive substrate is coated and dried, cured or crosslinked, or the like. In the case of this method, a hollow-shaped resin particle can be formed by using heat during drying, pulverizing or crosslinking a binder used for the pre-coating layer to expand the included substance. At this time, the particle diameter can be controlled by controlling the temperature conditions.

In the case that a thermally expandable microcapsule is used, it is needed to use a thermoplastic resin as the binder. Examples of the thermoplastic resin are as follows. An acrylonitrile resin, a vinyl chloride resin, a vinylidene chloride resin, a methacrylic acid resin, a styrene resin, a butadiene resin, a urethane resin, an amide resin, a methacrylonitrile resin, an acrylic acid resin, acrylate resins and methacrylate resins. Among them, particularly a thermoplastic resin containing at least one selected from the group consisting of an acrylonitrile resin, a vinylidene chloride resin and a methacrylonitrile resin, each of which has a low gas permeability and a high impact resilience, is more preferably used in order to control to the hardness distribution described later. One of these thermoplastic resins can be used singly, or two or more thereof can be used in combination. Further, monomers of some of these thermoplastic resins may be copolymerized into a copolymer.

As the substance to be included in a thermally expandable microcapsule, a substance which gasifies to expand at a temperature lower than or equal to the softening point of the thermoplastic resin can be used, and examples thereof are as follows. Low boiling point liquids such as propane, propylene, butene, n-butane, isobutane, n-pentane and isopentane; and high boiling point liquids such as n-hexane, isohexane, n-heptane, n-octane, isooctane, n-decane and isodecane.

The above thermally expandable microcapsule can be produced by using a known production method such as a suspension polymerization method, an interfacial polymerization method, an interfacial settling method and an in-liquid drying method. Examples of the suspension polymerization method include a method in which a polymerizable monomer, the above substance to be included in a thermally expandable microcapsule and a polymerization initiator are mixed together and the mixture is dispersed in an aqueous medium containing a surfactant or dispersion stabilizer, which is then subjected to suspension polymerization. Further, a compound having a reactive group which reacts with a functional group of a polymerizable monomer or an organic filler can be added thereto.

Examples of the polymerizable monomer are as follows. Acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylates (methyl acrylate, ethyl acrylate, n-butyl acrylate, isobutyl acrylate, t-butyl acrylate, isobornyl acrylate, cyclohexyl acrylate and benzyl acrylate), methacrylates (methyl methacrylate, ethyl methacrylate, n-butyl methacrylate, isobutyl methacrylate, t-butyl methacrylate, isobornyl methacrylate, cyclohexyl methacrylate and benzyl methacrylate), styrene-based monomers, acrylamide, substituted acrylamide, methacrylamide, substituted methacrylamide, butadiene, s-caprolactam, polyethers and isocyanates. One of these polymerizable monomers can be used singly, or two or more thereof can be used in combination.

The polymerization initiator is not particularly limited but is preferably an initiator soluble in a polymerizable monomer, and a known peroxide initiator and azo initiator can be used. Among them, an azo initiator is preferred. Examples of the azo initiator are as follows. 2,2'-azobisisobutyronitrile, 1,1'-azobiscyclohexan-1-carbonitrile and 2,2'-azobis-4-methoxy-2,4-dimethylvaleronitrile. Among them, 2,2'-azobisisobutyronitrile is preferred. In the case that an polymerization initiator is used, the amount thereof to be used can be 0.01 parts by mass or more and 5 parts by mass or less based on 100 parts by mass of a polymerizable monomer.

As the surfactant, an anionic surfactant, a cationic surfactant, a nonionic surfactant, an amphoteric surfactant or a polymer dispersant can be used. The amount of the surfactant to be used can be 0.01 parts by mass or more and 10 parts by mass or less based on 100 parts by mass of a polymerizable monomer. Examples of the dispersion stabilizer are as follows. Organic fine particles (a polystyrene fine particle, a polymethyl methacrylate fine particle, a polyacrylic acid fine particle and a polyepoxide fine particle), silica (colloidal silica), calcium carbonate, calcium phosphate, aluminum hydroxide, barium carbonate and magnesium hydroxide, etc. The amount of the dispersion stabilizer to be used can be 0.01 parts by mass or more and 20 parts by mass or less based on 100 parts by mass of a polymerizable monomer.

Suspension polymerization can be performed in a sealed environment using a pressure resistant vessel. Further, a polymerizable raw material may be suspended with a disperser or the like followed by transferring into a pressure resistant vessel and then subjecting to suspension polymerization, or a polymerizable raw material may be suspended in a pressure resistant vessel. The polymerization temperature can be 50° C. or higher and 120° C. or lower. Polymerization may be performed at the atmospheric pressure, but preferably performed at an increased, pressure (at a pressure equal to the atmospheric pressure plus a pressure of 0.1 MPa or more and 1 MPa or less) in order not to gasify the above substance to be included in a thermally expandable microcapsule. After the completion of polymerization, solid-liquid separation and washing may be carried out by centrifugation or filtration. In the case that solid-liquid separation or washing is carried out, drying or pulverization may be carried out thereafter at a temperature lower than or equal to the softening point of the resin contained in the thermally expandable microcapsule. Drying and pulverization can be carried out by using a known method, and a flash dryer, a wind dryer and a Nauta mixer can be used therefor. Further, drying and pulverization can be carried out simultaneously by using a crushing and drying machine. The surfactant and dispersion stabilizer can be removed by repeating washing and filtration after production.

[Method for Forming Pre-Coating Layer]

Next, methods for forming a pre-coating layer will be described. Examples of the method for forming a pre-coating layer include a method in which an electro-conductive resin composition layer, is formed on an electro-conductive substrate by using a coating method such as electrostatic spray coating, dip coating and roll coating and the layer is cured by drying, heating, crosslinking or the like. Another example of the method is a method in which a sheet-shaped or tube-shaped layer obtained by forming a film in a predetermined thickness with an electro-conductive resin composition followed by curing is bonded to an electro-conductive substrate or an electro-conductive substrate is coated with the layer. A further example of the method is a method in which an electro-conductive resin composition is placed in a mold with an electro-conductive substrate disposed therein followed by being cured to form a pre-coating layer. Particularly in the case that the binder is a rubber, pre-coating layer can also be provided by integrally extruding an electro-conductive substrate and an unvulcanized rubber composition using an extruder provided with a crosshead. A crosshead is an extrusion die for forming a coating layer on an electrical wire or a wire and is provided on the cylinder head of an extruder in use. Thereafter, the pre-coating layer is dried, cured or crosslinked, or the like, and the surface thereof is then ground so that the hollow-shaped resin particle is partly removed into a bowl shape. A cylinder grinding method or a tape grinding method can be used for the grinding method. Examples of the cylinder grinder include a traverse type NC cylinder grinder and a plunge-cutting type NC cylinder grinder.

(a) In the case that the thickness of the pre-coating layer is five times the average particle diameter of the hollow-shaped resin particle or less In the case that the thickness of the pre-coating layer is five times the average particle diameter of the hollow-shaped resin particle or less, a protrusion derived from the hollow-shaped resin particle is formed on the surface of the pre-coating layer in many cases. In this case, the protrusion of the hollow-shaped resin particle can be partly removed into a bowl shape so as to form an uneven shape derived from the opening of the bowl-shaped resin particle.

In this case, a tape grinding method can be used, in which the pressure applied on the pre-coating layer in grinding is relatively small. As an, example, preferred conditions for grinding the pre-coating layer using a tape grinding method are shown in the following. An abrasive tape is a tape obtained by dispersing an abrasive grain to a resin followed by applying it onto a sheet-like base material.

Examples of the abrasive grain include aluminum oxide, chromium oxide, iron oxide, diamond, cerium oxide, corundum, silicon nitride, silicon carbide, molybdenum carbide, tungsten carbide, titanium carbide and silicon oxide. The average particle diameter of the abrasive grain is preferably 0.01 μm or more and 50 or less, and more preferably 1 μm or more and 30 μm or less. The above average particle diameter of the abrasive grain is a median diameter D50 measured using a centrifugal settling method. The grit No. of the abrasive tape having the abrasive, grain in the above preferred range is preferably in a range of 500 or more and 20000 or less, and more preferably 1000 or more and 10000 or less. Specific examples of the abrasive tape are as follows. "MAXIMA LAP, MAXIMA T type" (trade name, Ref-Lite Co., Ltd.), "Lapika" (trade name, manufactured by KOVAX Corporation), "Micro Finishing Film", "Wrapping Film" (trade name, Sumitomo 3M Limited (new company name: 3M Japan Limited)), Mirror Film, Wrapping Film (trade name, manufactured by Sankyo-Rikagaku Co., Ltd.) and Mipox (trade name, manufactured by Mipox Corporation (old company name: Nihon Micro Coating Co., Ltd.)).

The feed speed for the abrasive tape is preferably 10 mm/min or more and 500 mm/min or less, and more preferably 50 mm/min or more and 300 mm/min or less. The pressing pressure of the abrasive tape on the pre-coating layer is preferably 0.01 MPa or more and 0.4 MPa or less, and more preferably 0.1 MPa or more and 0.3 MPa Or less. In order to control the pressing pressure, a backup roller may be brought into contact with the pre-coating layer via the abrasive tape. Further, a grinding treatment may be carried out several times in order to obtain a desired shape. The rotational frequency is preferably set to 10 rpm or more and 1000 rpm or less, and more preferably set to 50 rpm or more and 800 rpm or less. The above conditions enable to form an uneven shape derived from the opening of a bowl-shaped resin particle on the surface of the pre-coating layer more easily. Even in the case that the thickness of the pre-coating layer is out of the above range, an uneven shape derived from the opening of a bowl-shaped resin particle can be formed by using the method (b) described below.

(b) In the case that the thickness of the pre-coating layer is more than five times the average particle diameter of the hollow-shaped resin particle In the case that the thickness of the pre-coating layer is more than five times the average particle diameter of the hollow-shaped resin particle, no protrusion derived from the hollow-shaped resin particle may be formed on the surface of the pre-coating layer in some cases. In such a case, an uneven shape derived from the opening of, a bowl-shaped resin particle can be formed by utilizing the difference in grinding properties between the hollow-shaped resin particle and the material for the pre-coating layer. The hollow-shaped resin particle includes a gas inside, and therefore has a high impact resilience. In response to this fact, a rubber or resin having a relatively small impact resilience and a small elongation is selected as the binder for the pre-coating layer. This enables to achieve a state in which the pre-coating layer can be well ground and the hollow-shaped resin particle is poorly ground. By grinding the pre-coating layer in the above state, the hollow-shaped resin particle can be partly removed into a bowl shape without being ground in the same state as the pre-coating layer. Thereby, an uneven shape derived from the opening of the bowl-shaped resin particle can be formed on the surface of the pre-coating layer. Because this method is a method utilizing the difference in grinding properties between the hollow-shaped resin particle and the material for the pre-coating layer to form an uneven shape, the material (binder) used for the pre-coating layer is preferably a rubber. Among rubbers, an acrylonitrile-butadiene rubber, a styrene-butadiene rubber or a butadiene rubber is particularly preferably used from the viewpoint of small impact resilience and small elongation.

[Grinding Method]

Although a cylinder grinding method or a tape grinding method can be used for the grinding method, conditions for quicker grinding are preferred because it is needed to derive the difference in grinding properties between materials significantly. From this viewpoint, a cylinder grinding method is more preferably used. Among cylinder grinding methods, a plunge-cutting method is still more preferably used from the viewpoint of enabling to grind the pre-coating layer in the longitudinal direction simultaneously and to shorten the grinding time. Further, it is preferred to carry out a spark-out process (a grinding process at an intrusion speed of 0 mm/min), which has been conventionally carried out from the viewpoint of uniforming the ground surface, for as short time as possible, or not to carry out a spark-out process.

As an example, the rotational frequency of a cylindrical grinding wheel used for the plunge-cutting method is preferably 1000 rpm or more and 4000 rpm or less, and particularly preferably 2000 rpm or more and 4000 rpm or less. The intrusion speed into the pre-coating layer is preferably 5 mm/min or more and 30 mm/min or less, and particularly preferably 10 mm/min or more and 30 mm/min or less. At the last of an intrusion process, a conditioning process may be carried out for the ground surface, and the conditioning process can be carried out at an intrusion speed of 0.1 mm/min or more and 0.2 mm/min or less for within 2 seconds. A spark-out process (a grinding process at an intrusion speed of 0 mm/min) can be carried out for 3 seconds or shorter. The rotational frequency is preferably set to 50 rpm or more and 500 rpm or less, and more preferably set to 200 rpm or more. The above conditions enable to form an uneven shape derived from the opening of a bowl-shaped resin particle on the surface of the pre-coating layer more easily.

In the following description, the ground pre-coating layer is simply referred to as "coating layer".

[Method for Controlling Surface Hardness]

In the charging member, the ratio S satisfies the range represented by the formula (1), and the ratio d satisfies the range represented by the formula (2). In order to ensure these conditions, the value of "M2/M1" is preferably less than 1, and more preferably 0.7 or less, as described above. As the method for setting the value of "M2/M1" to less than 1, a method can be used in which the surface of the charging member is oxidatively cured by heat treatment in the atmosphere using a material having a low oxygen permeability of 140 $cm^3/(m^2 \cdot 24\ h \cdot atm)$ or less as the material for the shell of the bowl-shaped resin particle.

In the heat treatment in the atmosphere, the molecular chain of the binder and the molecular chain of the material forming the shell of the bowl-shaped resin particle are oxidatively crosslinked to increase the Martens hardness of the electro-conductive elastic layer. The degree of this oxidative crosslinking is influenced by the heat treatment temperature and the oxygen concentration in the crosslinking portion. Regarding the oxygen concentration, the higher the oxygen concentration in the crosslinking portion, the more oxidative crosslinking progresses. Accordingly, the Martens hardness of the binder immediately beneath the concavity of the bowl (E in FIG. 8) can be controlled by controlling the oxygen gas permeability of the shell material of the bowl-shaped resin particle.

Specifically, in the case that the oxygen gas permeability of the shell material of the bowl-shaped resin particle is small, while the Martens hardness M1 of the binder on the surface of the charging member. (F in FIG. 8) will become a large value due to the progression of oxidative crosslinking, the Martens hardness M2 of the binder immediately beneath the concavity of the bowl (E in FIG. 8) will not become a large value because oxidative crosslinking poorly progresses. The reason is that the amount of oxygen supplied to the binder immediately beneath the concavity of the bowl is small. As a result, the M2 value is smaller than the M1 value. Due to the M1 value being larger, the warp of the protrusion derived from the edge of the bowl in the nip portion is suppressed and the ability to maintain the point contact state is enhanced. In addition, the M2 value being smaller than the M1 value enables the bowl-shaped resin particle to sink down into the inward direction of the electro-conductive elastic layer, as indicated by the above-described arrow B in FIG. 1A, in the nip portion. Accordingly, the bowl-shaped resin particle itself with a load applied to the edge sinks down into the inward direction of the electro-conductive elastic layer while maintaining the point contact state, and as a result the contact pressure can be relaxed.

On the contrary, in the case that the oxygen gas permeability of the shell material of the bowl-shaped resin particle is large, the M1 value is almost equal to the M2 value because a sufficient amount of oxygen is supplied to the binder immediately beneath the concavity of the bowl. As a result, it becomes difficult for the bowl-shaped resin particle to sink down into the inward direction of the electro-conductive elastic layer as indicated by the arrow B in FIG. 1A and therefore the contact pressure cannot be suitably relaxed, which may cause the non-uniform abrasion of a photosensitive member.

In order to obtain the charging member, it is very effective to form a bowl-shaped resin particle using a material having a low oxygen permeability, as described above. Accordingly, it is preferred to use an acrylonitrile resin, a vinylidene chloride resin, methacrylonitrile resin, a methyl methacrylate resin or a copolymer of these resins, each of which has a low oxygen gas permeability, and it is particularly preferred to use an acrylonitrile resin or a vinylidene chloride resin.

As the method for heat treatment, a known method can be used such as a continuous hot air furnace, an oven, a near infrared ray heating method and a far infrared ray heating method, but the method is not limited to these methods as long as the method enables to heat-treat the surface of the charging member in the atmosphere. The heating temperature is preferably 180° C. or higher and 240° C. or lower, and more preferably 210° C. or higher and 240° C. or lower. In the temperature range, the effect of oxidative crosslinking due to heating is promoted, and shrinkage owing to the volatilization of a low-molecular weight component in the binder can be prevented.

As the above-described binder, a styrene-butadiene rubber (SBR), a butyl rubber, an acrylonitrile-butadiene rubber (NBR), a chloroprene rubber (CR) or a butadiene rubber (BR), each of which has a double bond in the molecule and has a high heat resistance, can be used from the viewpoint of promoting the effect of oxidative crosslinking.

<Electrophotographic Apparatus>

Figure 10:
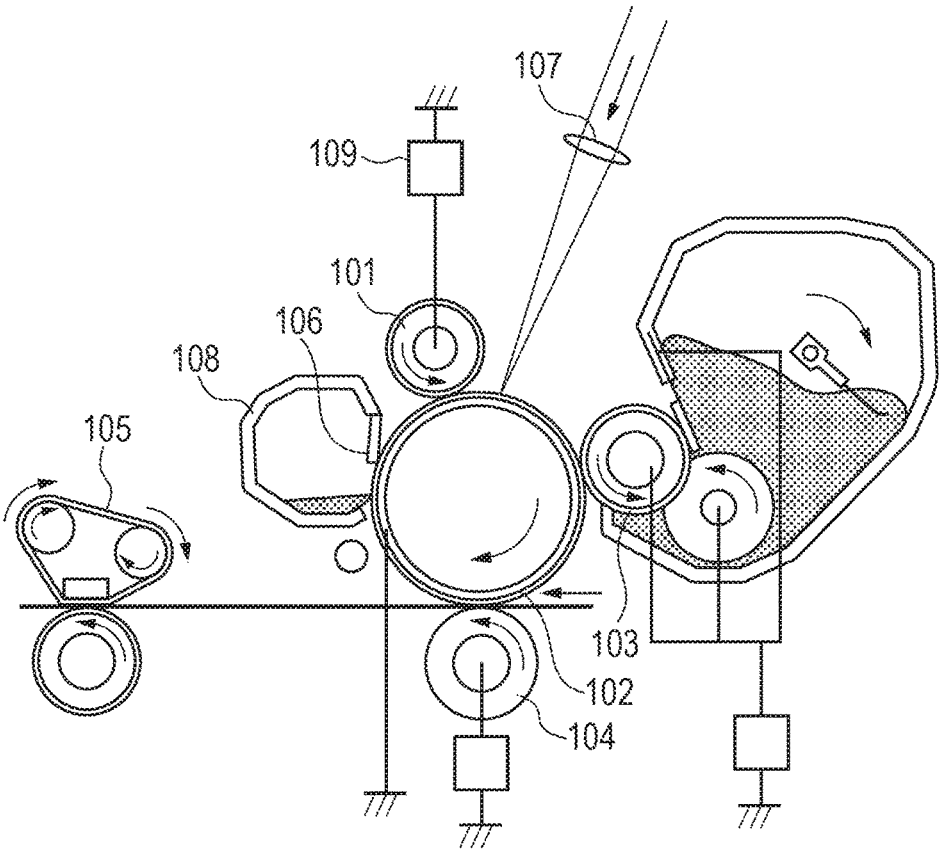
FIG. 10 is a schematic cross-sectional view illustrating one example of an electrophotographic apparatus according to the present invention.

A schematic configuration of one example of an electrophotographic apparatus is illustrated in FIG. 10. This electrophotographic apparatus includes an electrophotographic photosensitive member, a charging device to charge the electrophotographic photosensitive member, a latent image-forming device to expose the electrophotographic photosensitive member to form an electrostatic latent image, a developing device to develop the electrostatic latent image as a toner image, a transfer device to transfer the toner image onto a transfer medium, a cleaning device to collect a transfer residual toner on the electrophotographic photosensitive member, a fixing device to fix the toner image onto the transfer medium, and so on. The charging member according to the present invention can be used for a charging member included in the charging device in this electrophotographic apparatus.

The electrophotographic photosensitive member 102 is a rotary drum type having a photosensitive layer on an electro-conductive substrate. The electrophotographic photosensitive member 102 is rotationally driven to the direction of the arrow at a predetermined rotational speed (process speed). The charging device has a contact charging roller 101 which is brought into contact with the electrophotographic photosensitive member 102 at a predetermined pressing pressure to be disposed in contact therewith. The charging roller 101, a driven-rotary type which rotates following the rotation of the electrophotographic photosensitive member 102, is applied with a predetermined DC voltage by a power source 109 for charging the electrophotographic photosensitive member 102 to a predetermined electrical potential. As the latent image-forming device (not illustrated) to form an electrostatic latent image on the electrophotographic photosensitive member 102, an exposing device such as a laser beam scanner is used. The uniformly charged electrophotographic photosensitive member 102 is irradiated with an exposure light 107 corresponding to image information to form an electrostatic latent image.

The developing device has a developing sleeve or a developing roller 103 disposed adjacent to or in contact with the electrophotographic photosensitive member 102. The developing device develops the electrostatic latent image to form a toner image by reversal development using a toner electrostatically treated into the same polarity as the charged polarity of the electrophotographic photosensitive member 102. The transfer device has a contact transfer roller 104. The transfer device transfers the toner image from the electrophotographic photosensitive member 102 onto a transfer medium such as a plain paper. The transfer medium is conveyed by a paper feeding system including a conveying member.

The cleaning device, which has a blade type cleaning member 106 and a collection container 108, mechanically scrapes off and collects a transfer residual toner remaining on the electrophotographic photosensitive member 102 after the developed toner image is transferred onto the transfer medium. Here, the cleaning device can be even omitted by employing a cleaning-at-developing method, in which a transfer residual toner is collected in a developing device. The toner image transferred onto the transfer medium passes through between a fixing belt 105 heated with a nonillustrated heating apparatus and a roller disposed opposite to the fixing belt 105 and as a result fixed onto the transfer medium.

<Process Cartridge>

Figure 11:
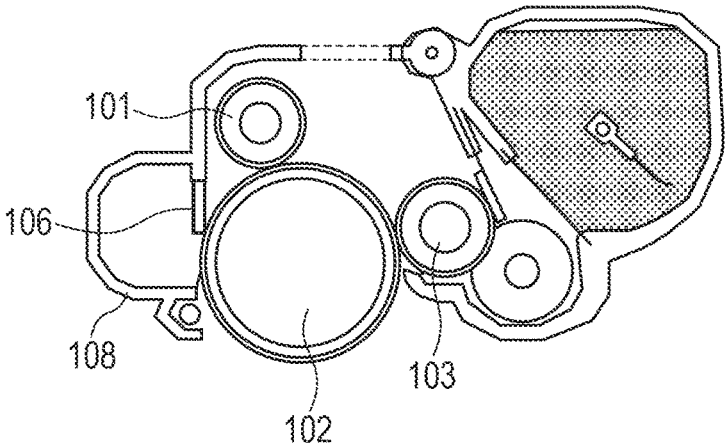
FIG. 11 is a schematic cross-sectional view illustrating one example of a process cartridge according to the present invention.

A schematic configuration of one example of a process cartridge is illustrated in FIG. 11. This process cartridge integrates an electrophotographic photosensitive member 102, a charging roller 101, a developing roller 103, a cleaning member 106 and the like and is configured to be attachable to and detachable from the main body of an electrophotographic apparatus. The charging member according to the present invention can be used for a charging roller in this process cartridge.

EXAMPLES

Hereinafter, the present invention will be described in more detail by giving specific Production Examples and Examples. First, prior to Examples, Production Examples 1 to 8 (production of resin particles 1 to 8), a method for measuring the volume average particle diameter, Production Examples 11 to 16 (production of sheets for measuring gas permeability 1 to 6), a method for measuring the oxygen gas permeability of a resin particle and Production Examples 21 to 32 (production of electro-conductive rubber compositions 1 to 12) are described.

Note that parts and % in the following Examples and Comparative Examples are all based on mass unless otherwise specified.

Production Example 1: Production of Resin Particle No. 1

An aqueous mixed solution was prepared containing 4000 parts by mass of ion-exchanged water, 9 parts by mass of colloidal silica as a dispersion stabilizer and 0.15 parts by mass of polyvinylpyrrolidone. Then, an oily mixed solution was prepared containing 50 parts by mass of acrylonitrile, 45 parts by mass of methacrylonitrile and 5 parts by mass of methyl acrylate as polymerizable monomers, and 12.5 parts by mass of n-hexane as an included substance, and 0.75 parts by mass of dicumyl peroxide as a polymerization initiator. This oily mixed solution was added to the aqueous mixed solution and 0.4 parts by mass of sodium hydroxide was further added thereto to prepare a dispersion.

The obtained dispersion was stirred to mix together with a homogenizer for 3 minutes, charged into a polymerization reactor which had been purged with nitrogen, and reacted at 60° C. for 20 hours while stirring at 400 rpm to prepare a reaction product. The obtained reaction product was subjected to filtration and washing with water repeatedly, and then dried at 80° C. for 5 hours to produce resin particles. These resin particles were cracked and classified with a sonic classifier to obtain a resin particle No. 1. The physical properties of the resin particle 1 are shown in Table 1.

Production Example 2: Production of Resin Particle No. 2

A resin particle No. 2 was produced with the same method as in Production Example 1 except that classifying conditions were changed. The physical properties of the resin particle No. 2 are shown in Table 1.

Production Examples 3 to 8: Production of Resin Particle's Nos. 3 to 8

Resin particles were produced with the same method as in Production Example 1 except that one or more of the amount of colloidal silica used, the type and amount of a polymerizable monomer used, and the rotational frequency for stirring in polymerization Were changed, and classified to obtain resin particles Nos. 3 to 8, respectively. The physical properties of the respective resin particles are shown in Table 1.

TABLE 1

| Production Example | Resin particle No | Amount of colloidal silica used [parts by mass] | Polymerizable monomer and amount thereof used [parts by mass] | Rotational frequency for stirring [rpm] | Resin particle diameter [μm] |
|---|---|---|---|---|---|
| 1 | 1 | 9 | Acrylonitrile 50-methacrylonitrile 45-methyl acrylate 5 | 400 | 30 |
| 2 | 2 | 9 | Acrylonitrile 50-methacrylonitrile 45-methyl acrylate 5 | 400 | 15 |
| 3 | 3 | 4.5 | Acrylonitrile 50-methacrylonitrile 45-methyl acrylate 5 | 400 | 50 |
| 4 | 4 | 9 | Acrylonitrile 80-methacrylonitrile 20 | 400 | 28 |
| 5 | 5 | 4.5 | Acrylonitrile 100 | 400 | 25 |
| 6 | 6 | 9 | Methyl methacrylate 100 | 250 | 40 |
| 7 | 7 | 9 | Vinylidene chloride 100 | 400 | 25 |
| 8 | 8 | 4.5 | Polybutadiene 100 | 300 | 60 |

<Measurement for Volume Average Particle Diameter of Resin Particle>

The volume average particle diameter of each of the resin particles Nos. 1 to 8 was measured using a laser diffraction particle size analyzer (trade name: Coulter LS-230 Particle Size Analyzer, manufactured by Beckmann Coulter, Inc.).

For the measurement, an aqueous module was used and pure water was used as the solvent for measurement. After the inside of the measuring system of the particle size analyzer was washed with pure water for about 5 minutes, 10 mg to 25 mg of sodium sulfite as an antifoamer was added into the measuring system and a background function was executed. Subsequently, 3 to 4 drops of a surfactant was added into 50 ml of pure water, and 1 mg to 25 mg of a sample to be measured was further added thereto. The aqueous solution with the sample suspended therein was dispersed with an ultrasonic disperser for 1 minute to 3 minutes to prepare a sample solution to be tested. The sample solution to be tested was gradually added into the measuring system of the measuring apparatus, and after the concentration of the sample to be tested in the measuring system was adjusted so that PIDS on the display of the apparatus was 45% or more and 55% or less, measurement was performed. The volume average particle diameter was calculated from the obtained volume distribution.

Production Example 11: Production of Sheet for Measuring Gas Permeability No. 1

The sheet in this Production Example is a sheet for measuring the gas permeability of a resin material obtained by removing an included substance from a resin particle. The resin particle 1 was heated and decompressed at 100° C. for removing the included substance to obtain a resin composition. Thereafter, a metal mold (ϕ 70 mm, 500 μm in depth) heated to 160° C. was filled with the resin composition, and pressurized at a pressure of 10 MPa to obtain a circular sheet for measuring gas permeability 1 having a diameter of 70 mm and a thickness of 500 μm.

Production Examples 12 to 16: Production of Sheets for Measuring Gas Permeability Nos. 2 to 6

Sheets for measuring gas permeability Nos. 2 to 6 were obtained with the same method as in the above using the resin particles Nos. 4 to 8, respectively, in place of the resin particle No. 1.

<Measurement for Oxygen Gas Permeability of Sheet>

Using each of the sheets for measuring gas permeability No. 1 to 6, the oxygen gas permeability was measured according to the differential-pressure method described in JIS K 7126 under the following conditions:

measuring apparatus: gas permeability tester M-C3 (manufactured by Toyo Seiki Seisaku-Sho, Ltd.)
gas used: oxygen gas corresponding to JIS K 1101
measuring temperature: 23±0.5° C.
test pressure: 760 mmHg
permeation area: 38.46 $cm^2$ (ϕ 70 mm)
sample thickness: 500 μm.

Specific operations are as follows. First, a sheet for measuring gas permeability is installed in a permeation cell, and fixed at a uniform pressure so as not to cause an air leakage. The low pressure side and high pressure side in the measuring apparatus were evacuated, and then the evacuation in the low pressure side was stopped and kept vacuum. Thereafter, an oxygen gas was introduced into the high pressure side at 1 atm, and the pressure of the high pressure side at this time was defined as Pu. After the pressure of the low pressure side began to increase and it was confirmed that the oxygen gas was permeated, a permeation curve (horizontal axis: time, vertical axis: pressure) was drawn and measurement was continued until a straight line, an indication of a steady state permeation, was confirmed. After the completion of the measurement, defining the gradient of the permeation curve as $d_p/d_t$, the oxygen gas permeability GTR was calculated using the following formula (9).

$$GTR = \frac{273 \times Vc \times 24}{T \times A \times P_u} \frac{d_p}{d_t} \quad \text{Formula (9)}$$

(Vc: low pressure side volume, T: test temperature, Pu: differential pressure of supplied gas, A: permeation area, $d_p/d_t$: pressure change per unit time in low pressure side)

The results for the above Production Examples 11 to 16 are shown in the following Table 2.

TABLE 2

| Production Example | Sheet No. for measuring gas permeability | Resin particle | Oxygen gas permeability [$cm^3/m^3 \cdot 24\ h \cdot atm$] |
|---|---|---|---|
| 11 | 1 | Resin particle 1 | 44 |
| 12 | 2 | Resin particle 4 | 30 |
| 13 | 3 | Resin particle 5 | 13 |
| 14 | 4 | Resin particle 6 | 140 |
| 15 | 5 | Resin particle 7 | 16 |
| 16 | 6 | Resin particle 8 | 29600 |

Production Example 21: Production of Electro-Conductive Rubber Composition No. 1

To 100 parts by mass of an acrylonitrile-butadiene rubber (NBR) (trade name: N230SV, manufactured by JSR corporation), other materials listed in the column "Component (1)" in Table 3 were added, and the resultant was kneaded using a sealed mixer with the temperature controlled to 5.0° C. for 15 minutes. To this kneaded product, materials listed in the column "Component (2)" in Table 3 were added. The resultant was then kneaded using a two-roll mill cooled to a temperature of 25° C. for 10 minutes to obtain electro-conductive rubber composition No. 1.

TABLE 3

| | Material | Amount used (parts by mass) |
|---|---|---|
| Component (1) | Acrylonitrile-butadiene rubber (NBR) (trade name: N230SV, manufactured by JSR Corporation | 100 |
| | Carbon black (trade name: TOKABLACK #7360SB, manufactured by Tokai Carbon Co., Ltd.) | 48 |
| | Zinc oxide (trade name: Zinc Oxide No. 2, manufactured by Sakai Chemical Industry Co., Ltd.) | 5 |
| | Zinc stearate (trade name: SZ-2000, manufactured by Sakai Chemical Industry Co., Ltd.) | 1 |
| | Calcium carbonate (trade name: NANOX#30, manufactured by Maruo Calcium Co., Ltd.) | 20 |
| Component (2) | Resin particle 1 | 12 |
| | Sulfur (vulcanizing agent) | 1.2 |
| | Vulcanization accelerator tetrabenzylthiuram disulfide (TBzTD) (trade name: PERKACIT TBzTD, manufactured by Performance Additives) | 4.5 |

Production Examples 22 and 23: Production of Electro-Conductive Rubber Compositions No. 2 and No. 3

Electro-conductive rubber compositions No. 2 and No. 3 were obtained in the same way as in Production Example 21 except that the part of the resin particle No. 1 in Production. Example 21 for producing electro-conductive rubber composition No. 1 was changed to the respective amounts listed in Table 5.

Production Examples 24 to 29: Production of Electro-Conductive Rubber Compositions Nos. 4 to 9

Electro-conductive rubber compositions Nos. 4 to 9 were obtained in the same way as in Production Example 21 except that the resin particle 1 in Production Example 21 for producing the electro-conductive rubber composition 1 was changed to respective resin particles (resin particles Nos. 2 to 7) listed in Table 5.

Production Example 30: Production of Electro-Conductive Rubber Composition No. 10

To 100 parts by mass of a styrene-butadiene rubber (SBR) (trade name: Tufdene 2003, manufactured by Asahi Kasei. Chemicals Corporation), other materials listed in the column "Component (1)" in Table 4 were added, and the resultant was kneaded using a sealed mixer with the temperature controlled to 80° C. for 15 minutes. To this kneaded product, materials listed in the column "Component (2)" in Table 4 were added. The resultant was then kneaded using a two-roll mill cooled to a temperature of 25° C. for 10 minutes to obtain an electro-conductive rubber composition No. 10.

Production Example 31: Production of Electro-Conductive Rubber Composition No. 11

Electro-conductive rubber composition No. 11 was obtained in the same way as in Production. Example 21 except that, in Production Example 21 for producing the electro-conductive rubber composition No. 1, the acrylonitrile-butadiene rubber was changed to a butadiene rubber (BR) (trade name: JSR BR01, manufactured by JSR Corporation) and the amount of the carbon black was changed to 30 parts by mass.

Production Example 32: Production of Electro-Conductive Rubber Composition No. 12

Electro-conductive rubber composition No. 12 was Obtained in the same way as in Production Example 21 except that the resin particle 1 in Production Example 21 for producing the electro-conductive rubber composition No. 1 was changed to the resin particle 8.

TABLE 4

| | Material | Amount used (parts by mass) |
|---|---|---|
| Component (1) | Styrene-butadiene rubber (SBR) (trade name: Tufdene 2003, manufactured by Asahi Kasei Chemicals Corporation) | 100 |
| | Carbon black (trade name: KETJENBLACK EC600JD, manufactured by Lion Corporation (new company name: Lion Specialty Chemicals Co., Ltd.)) | 8 |
| | Carbon black (trade name: SEAST 5, manufactured by Tokai Carbon Co., Ltd.) | 40 |
| | Zinc oxide (trade name: Zinc Oxide No. 2, manufactured by Sakai Chemical Industry Co., Ltd.) | 5 |
| | Zinc stearate (trade name: SZ-2000, manufactured by Sakai Chemical Industry Co., Ltd.) | 1 |
| | Calcium carbonate (trade name: NANOX#30, manufactured by Maruo Calcium Co., Ltd.) | 15 |
| Component (2) | Resin particle 1 | 12 |
| | Sulfur (vulcanizing agent) | 1 |
| | Dibenzothiazyl disulfide (DM) (trade name: NOCCELER-DM, manufactured by Ouchi Shinko Chemical Industrial Co., Ltd., vulcanization accelerator) | 1 |
| | Tetramethylthiuram monosulfide (TS) (trade name: NOCCELER-TS, manufactured by Ouchi Shinko Chemical Industrial Co., Ltd., vulcanization accelerator) | 1 |

TABLE 5

| Production Example | Electro-conductive rubber composition No. | Resin (rubber) Type | Resin (rubber) Grade | Carbon black Type | Carbon black Parts by mass | Zinc oxide [parts by mass] | Zinc stearate [parts by mass] | Calcium carbonate [parts by mass] | Sulfur [parts by mass] | Vulcanization accelerator Type | Vulcanization accelerator Parts by mass | Resin particle No | Resin particle Parts by mass |
|---|---|---|---|---|---|---|---|---|---|---|---|---|---|
| 21 | 1 | NBR | N230SV | #7360SB | 48 | 5 | 1 | 20 | 1.2 | TBzTD | 4.5 | 1 | 12 |
| 22 | 2 | | | | | | | | | | | 1 | 8 |
| 23 | 3 | | | | | | | | | | | 1 | 16 |
| 24 | 4 | | | | | | | | | | | 2 | 12 |
| 25 | 5 | | | | | | | | | | | 3 | 12 |
| 26 | 6 | | | | | | | | | | | 4 | 12 |
| 27 | 7 | | | | | | | | | | | 5 | 12 |
| 28 | 8 | | | | | | | | | | | 6 | 12 |
| 29 | 9 | | | | | | | | | | | 7 | 12 |
| 30 | 10 | SBR | Tufdene 2003 | KETJEN | 8 | 5 | 1 | 15 | 1 | DM | 1 | 1 | 12 |
| | | | | SEAST | 40 | | | | | TS | 1 | | |
| 31 | 11 | BR | BR01 | #7360SB | 30 | 5 | 1 | 20 | 1.2 | TBzTD | 4.5 | 1 | 12 |
| 32 | 12 | NBR | N230SV | #7360SB | 48 | 5 | 1 | 20 | 1.2 | TBzTD | 4.5 | 8 | 12 |

Example 1

[1. Electro-Conductive Substrate]

A thermosetting resin containing 10% by mass of carbon black was applied onto a stainless steel substrate with a diameter of 6 mm and a length of 252.5 mm and dried, which was used as an electro-conductive substrate.

[2. Formation of Electro-Conductive Elastic Layer]

Using an extrusion machine provided with a crosshead, the circumferential surface of the electro-conductive substrate as a central axis was cylindrically coated with the electro-conductive rubber composition 1 produced in Production Example 21. The thickness of the coating of the electro-conductive rubber composition 1 was adjusted to 1.75 mm.

The roller after extrusion was vulcanized in a hot air furnace at 160° C. for 1 hour, and the ends of the rubber layer was then removed to be a length of 224.2 mm to produce a roller having a pre-coating layer. The outer circumferential surface of the obtained roller was ground using a plunge-cutting type cylinder grinder. A vitrified grinding wheel was used for the abrasive grain, the material of which was green silicon carbide (GC) and the grain size was 100 mesh. The rotational frequency of the roller was set to 350 rpm and the rotational frequency of the grinding wheel was set to 2050 rpm. Grinding was carried out with the cut-in speed set to 20 mm/min and with the spark-out time (time of 0 mm cut-in) set to 0 seconds to produce an electro-conductive roller having an electro conductive elastic layer (coating layer). The thickness of the electro-conductive elastic layer was adjusted to 1.5 mm. The quantity of the crown (the average value of differences between the outer diameter of the center portion and the outer diameter at a position distant from the center portion to the direction of the respective ends by 90 mm) of this roller was 120 μm.

After grinding, post-heat treatment was performed in a hot air furnace at 210° C. for 1 hour to obtain a charging member 1. This charging member 1 included an electro-conductive resin layer having a protrusion derived from the edge of an opening of a bowl-shaped resin particle and a concavity derived from an opening of a bowl-shaped resin particle on the surface. The results of physical properties measurement and image evaluation for the charging member 1 using the following methods are shown in Tables 6 and 7.

[3. Method for Evaluating Charging Member]

[3-1. Measurement for Surface Roughness Rzjis and Average Concave to Convex Distance Sm of Charging Member]

Measurement was performed according to the standard of JIS B 0601-1994 surface roughness using a surface roughness meter (trade name: SE-3500, manufactured by Kosaka Laboratory Ltd.). For Rz and Sm, measurements were performed at randomly selected 6 points of the charging member and the average value was used. The cut-off value was 0.8 mm and the evaluation length was 8 mm.

[3-2. Measurement for Shape of Bowl-Shaped Resin Particle]

The number of measurement points was 10 in total: specifically, 5 points consisting of the center portion, points distant from the center portion to the direction of the respective ends by 45 mm, and, points distant from the center portion to the direction of the respective ends by 90 mm in the longitudinal direction of the charging member were measured at 2 phases in the circumferential direction (phases 0° and 180°) of the charging member. At each of these measurement points, the electro-conductive resin layer was cut out in 20 nm length respectively over 500 μm and the cross-sectional images were taken using a focused ion beam processing/observation apparatus (trade name: FB-2000C, manufactured by Hitachi, Ltd.). The obtained cross-sectional images were then combined to determine the stereoscopic image of the bowl-shaped resin particle. From the stereoscopic image, the "Maximum diameter" 55 as illustrated in FIG. 6 and the "Minimum diameter of opening portion" 63 as illustrated in FIGS. 7A to 7E were calculated. The definition of "Maximum diameter" is as described above.

Further, at arbitrarily selected 10 points of the bowl-shaped resin particle in the above stereoscopic image, the "difference between outer diameter and inner diameter", i.e., the "Shell thickness" of the bowl-shaped resin particle was calculated. This measurement was performed for 10 resin particles in the view, and the average value of the obtained 100 measurements in total was calculated. The "Maximum diameter", "Minimum diameter of opening portion" and "Shell thickness" shown in Table 6 are each the average value calculated using the above method. In measuring the shell thickness, it was confirmed for each of the bowl-shaped resin particles that the thickness of the thickest portion of the shell was twice the thickness of the thinnest portion or less; that is, the shell thickness was generally uniform.

[3-3. Measurement for Height Difference Between Top of Protrusion and Bottom of Concavity on Surface of Charging Member]

The surface of the charging member was observed using a laser microscope (trade name: LSM5 PASCAL, manufactured by Carl Zeiss) with a view of 0.5 mm height×0.5 mm width. The X-Y plane in the view was scanned with a laser to obtain two-dimensional image data, and the focus was moved in the Z direction to repeat the above scanning in order, to obtain three-dimensional image data. From the result, it was first confirmed that the concavity derived from the opening of the bowl-shaped resin particle and the protrusion derived from the edge of the opening of the bowl-shaped resin particle were present. Further, the height difference 54 between the top of the protrusion 53 and the bottom of the concavity 52 was calculated. These operations were performed for two bowl-shaped resin particles in the view. And the same measurement was performed at 50 points in the longitudinal direction of the charging member T1, and the average value of the obtained measurements for 100 resin particles in total was calculated, which was shown in Table 6 as "Height difference".

[3-4. Measurement for Surface Hardness of Charging Member]

Measurement was performed using a surface film physical properties tester (trade name: PICODENTOR HM500, manufactured by Helmut Fischer GmbH+Co. KG) according to ISO 14577. A quadrangular pyramid-shaped diamond Vickers indenter was used for the indenter. For each of arbitrarily selected 10 measurement points in the center portion in the longitudinal direction on the surface of the charging member, Martens hardness was measured at 2 points in the vicinity of the measurement point, i.e., the binder (non-bowl particle portion) and the concavity of the bowl (bowl particle portion). The Martens hardness M1 and M2 were each calculated from the average value of the 10 measurements. Measurement for Martens hardness M2 was performed so that the center of the bottom of the concavity of the bowl was pressed by the indenter. The measurement conditions were as follows.

Measurement environment: temperature 23° C., relative humidity 50%

Maximum pressing depth=100 μm

Loading retention time (pressing time)=20 sec

Martens hardness was measured at a position of depth=20 μm. Since the shell thickness of the bowl was 1.5 μm, the Martens hardness M2 was measured at the electro-conductive elastic layer immediately beneath the concavity of the bowl.

[3-5. Measurement for Electrical Resistance Value of Charging Member]

Figure 4:
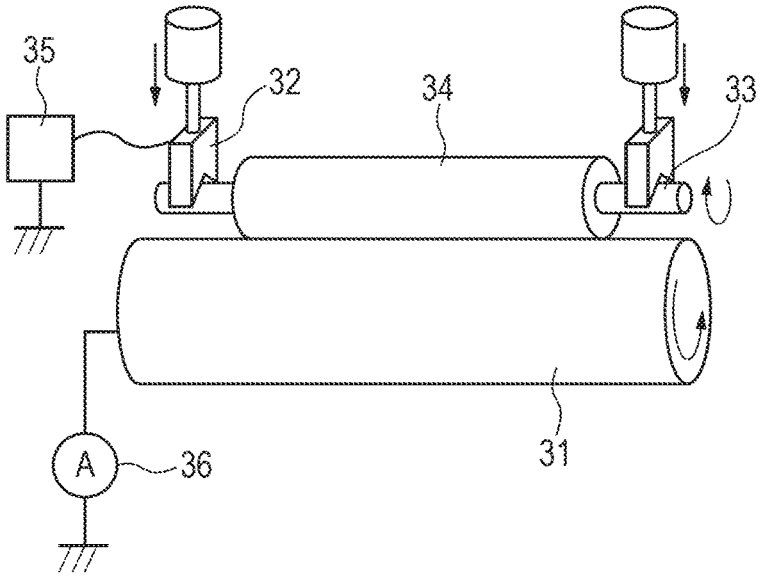
FIG. 4 is a schematic diagram of an electric current measuring apparatus.

FIG. 4 illustrates an apparatus for measuring the electrical resistance value of a charging member 34. Both ends of an electro-conductive substrate 33 were applied with a load through bearings 32 to bring the charging member into contact with a cylindrical metal 31 having the same curvature as that of an electrophotographic photosensitive member so as to be parallel to the cylindrical metal 31. While this state was maintained, the cylindrical metal 31 was rotated with a motor (not illustrated), and a DC voltage of −200 V from a stabilized power source 35 was applied thereto with the charging member 34 in contact driven-rotated. The electrical current at this time was measured using an ammeter 36, and the electrical resistance value of the charging member 34 was calculated. The loads were each 4.9 N, the diameter of the cylindrical metal 31 was 30 mm, and the rotational speed of the cylindrical metal 31 was 45 mm/sec. Before measurement, the charging member 34 was left to stand under an environment with a temperature of 23° C. and a relative humidity of 50% for 24 hours or longer, and measurement was performed by using a measuring apparatus which had been kept under the same environment.

[3-6. Measurement for Contact Area Formed Between Charging Member and Glass Plate]

Figure 9A:
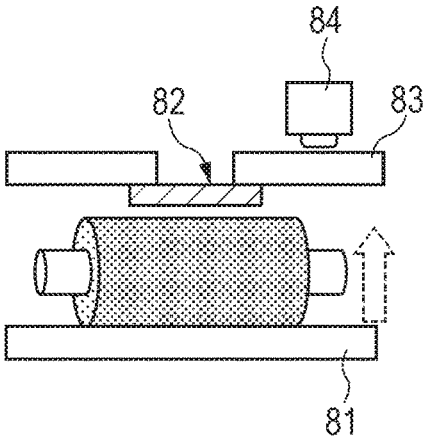
FIG. 9A is a schematic diagram of a jig to bring a glass plate into contact with the surface of a charging member.
Figure 9B:
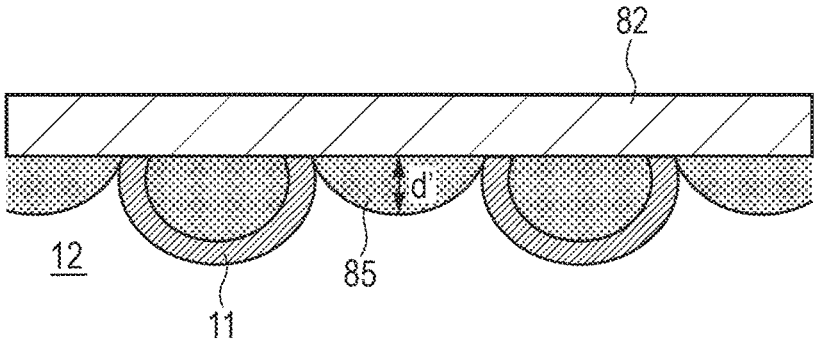
FIG. 9B is a diagram illustrating spaces formed between a glass plate and a charging member.

A jig having a lower stage 81, an upper stage 83 and a load meter 84, illustrated in FIG. 9A, was used. The charging member can be set on the lower stage 81 and the lower stage 81 can be moved vertically. The load applied when the charging member is pressed onto a glass plate 82 can be detected with the load meter 84.

The charging member set on the lower stage 81 was moved upward, and pressed onto a 20 mm square glass plate 82 with a thickness of 2 mm (material: BK7, surface accuracy: both sides optically grinded, parallelism: within 1') set on the upper stage 83 so that the load was 100 g, and the contact surface between the charging member and the glass plate 82 was observed from the glass plate side using a video microscope (trade name: DIGITAL MICROSCOPE VHX-500, manufactured by KEYENCE Corporation). Using an image analysis software (ImageProPlus®, manufactured by Media Cybernetics, Inc.) with the observation magnification of ×200, only the contact region R1 formed between the charging member and the glass plate was extracted to binarize, and the average value S1' of the contact areas per contact portion was calculated. The above measurement was performed at 9 points in total: specifically, 3 points consisting of the center portion and points distant from the center portion to the direction of the respective ends by 90 mm in the longitudinal direction of the charging member were measured at 3 phases in the circumferential direction (at an interval of 120°). The average value of S1' at these 9 points was used as S1.

Thereafter, the load applied onto the glass plate was changed to 500 g, and the average value S5 of the contact areas per contact portion was calculated using the same method. The ratio S represented in the formula (1) was calculated from these S1 and S5 values.

[3-7. Measurement for Height of Space Formed Between Charging Member and Glass Plate]

As in the measurement [3-6], a jig having the mechanism in FIG. 9A and a glass plate were used. The charging member was pressed onto the glass plate so that the load was 100 g, and the contact surface between the charging member and the glass plate was observed from the glass plate side using a one-shot 3D measurement microscope (trade name: VR-3000, manufactured by KEYENCE Corporation) to measure the surface shape of the charging member pressed onto the glass plate. The observation magnification was ×160. Using the shape measurement, the nip width (the nip length in the circumferential direction) was calculated as L μm from the cross-sectional profile and the space volume V1 $(\mu m)^3$ of the space formed between the charging member and the glass plate in a region of [nip width L μm]×[longitudinal direction A μm] was determined from a volume measurement. Thereafter, the average value d1' of the heights of the respective spaces was calculated using the following formula (10). Here, the length in the longitudinal direction (axis direction) A μm of the region for which the space volume V1 was calculated was 1000 μm. The above measurement was performed at 9 points in total: specifically, 3 points consisting of the center portion and points distant from the center portion to the direction of the respective ends by 90 mm in the longitudinal direction of the charging member were measured at 3 phases in the circumferential direction (at an interval of 120°). The average value of d1' at these 9 points was used as d1.

$$d1 = \frac{V1}{L \times A} \qquad \text{Formula (10)}$$

And then, the load applied onto the glass plate was changed to 500 g, and the average value d5 of the heights of the respective spaces was calculated using the same method. From these d1 and d5 values, the ratio d represented in the formula (2) was calculated.

[3-8. Image Evaluation]

[3-8-1. Evaluation for Abrasion Properties]

A monochrome laser printer ("LBP6700" (trade name)) manufactured by Canon Inc., an electrophotographic apparatus having a configuration illustrated in FIG. 10, was customized to make the process speed 370 mm/sec, and a voltage was further applied from the outside to the charging member 101. For the voltage, an AC voltage with a peak-to-peak voltage (Vpp) of 1800 V and a frequency (f) of 1350 Hz and a DC voltage (Vdc) of −600 V were applied. The resolution of an image to be output was 600 dpi.

As a process cartridge, the toner cartridge 524II for the above printer was used. An attached charging roller was detached from the process cartridge, and the charging member 1 was set thereon in place of the attached charging roller. The charging member 1 was brought into contact with the electrophotographic photosensitive member with a pressing pressure of 4.9 N at one end, i.e., 9.8 N in total at both ends through springs. This process cartridge was conditioned in a high temperature and high humidity environment with a temperature of 32.5° C. and a relative humidity of 80% for 24 hours, and thereafter evaluated for durability.

Specifically, a 2-print intermittent durability test (a test in which the rotation of a printer is stopped for 3 seconds every 2 sheets output) was carried out in which an image having horizontal lines of 2 dots in width at an interval of 176 dots extending in the direction perpendicular to the rotational direction of the electrophotographic photosensitive member was drawn. A halftone image (an image drawn with horizontal lines of 1 dot in width at an interval of 2 dots extending in the direction perpendicular to the rotational direction of the electrophotographic photosensitive member) was output every 10000 sheets, and after the above durability test was continued until 40000 sheets, evaluation was performed. In the evaluation, the halftone images were visually observed, and whether a vertically streaked defect due to the uneven abrasion of the photosensitive member was present or not in the electrophotographic image was determined using the following criteria.

rank 1: no vertically streaked defect was observed.

rank 2: a few vertically streaked defects were observed.

rank 3: vertically streaked defects were observed in some regions.

rank 4: vertically streaked defects were observed in a broad range and noticeable.

[3-8-2. Evaluation for Stain Resistance]

The process cartridge was conditioned in a low temperature and low humidity environment with a temperature of 15° C. and a relative humidity of 10% for 24 hours, and thereafter evaluated using the same electrophotographic apparatus and conditions for voltage application as in [3-8-1. Evaluation for abrasion properties]. In the evaluation, the obtained halftone images were visually observed, and whether dotted and horizontally streaked image defects due to a stain on the surface of the charging member was present or not was determined using the following criteria.

rank 1: no dotted or horizontally streaked defect was observed.

rank 2: a few dotted and horizontally streaked defects were observed.

rank 3: the occurrence of dotted and horizontally streaked defects was observed corresponding to the rotation pitch of the charging member.

rank 4: dotted and horizontally streaked defects were noticeable.

Examples 2 to 26

Charging members 2 to 26 were produced in the same way as in Example 1 except that one or more of the electro-conductive resin composition, the vulcanizing temperature and the heating temperature after grinding were changed to, respective conditions listed in Table 6, and evaluated. The evaluation results are shown in Tables 6 and 7.

Comparative Examples 1 to 6

Charging members C1 to C6 were produced in the same way as in Example 1 except that one or more of the electro-conductive resin composition, the vulcanizing temperature and the heating temperature after grinding were changed to respective conditions listed in Table 6, and evaluated. The evaluation results are shown in Tables 6 and 7.

TABLE 6

| No. | Charging member No. | Electro-conductive rubber composition No. | Resin particle No | Vulcanizing temperature [° C.] | Heating temperature after grinding [° C.] | Resistance of roller [Ω] | Rz [μm] | Sm [μm] | Height difference [μm] | Maximum diameter [μm] | Minimum diameter of opening portion [μm] | Shell thickness [μm] |
|---|---|---|---|---|---|---|---|---|---|---|---|---|
| Example 1 | 1 | 1 | 1 | 160 | 210 | $6.5 \times 10^5$ | 42 | 94 | 49 | 68 | 45 | 1.5 |
| Example 2 | 2 | 1 | 1 | 180 | 210 | $5.2 \times 10^5$ | 44 | 90 | 50 | 70 | 50 | 1.2 |
| Example 3 | 3 | 1 | 1 | 200 | 210 | $3.8 \times 10^5$ | 47 | 82 | 52 | 72 | 54 | 0.9 |
| Example 4 | 4 | 1 | 1 | 160 | 190 | $7.9 \times 10^5$ | 42 | 94 | 49 | 68 | 45 | 1.5 |
| Example 5 | 5 | 1 | 1 | 160 | 240 | $1.8 \times 10^5$ | 42 | 94 | 49 | 68 | 45 | 1.5 |
| Example 6 | 6 | 2 | 1 | 180 | 210 | $3.6 \times 10^5$ | 41 | 122 | 53 | 74 | 55 | 1.2 |
| Example 7 | 7 | 3 | 1 | 180 | 210 | $7.5 \times 10^5$ | 46 | 64 | 49 | 68 | 45 | 1.2 |
| Example 8 | 8 | 4 | 2 | 180 | 210 | $3.3 \times 10^5$ | 26 | 110 | 30 | 33 | 24 | 0.6 |
| Example 9 | 9 | 5 | 3 | 180 | 210 | $6.9 \times 10^5$ | 70 | 67 | 83 | 104 | 82 | 2 |
| Example 10 | 10 | 6 | 4 | 160 | 190 | $7.4 \times 10^5$ | 39 | 97 | 46 | 65 | 42 | 1.4 |
| Example 11 | 11 | 6 | 4 | 160 | 210 | $5.9 \times 10^5$ | 39 | 97 | 46 | 65 | 42 | 1.4 |
| Example 12 | 12 | 6 | 4 | 160 | 240 | $1.2 \times 10^5$ | 40 | 95 | 47 | 66 | 44 | 1.4 |
| Example 13 | 13 | 7 | 5 | 160 | 190 | $7.2 \times 10^5$ | 37 | 98 | 41 | 59 | 39 | 1.2 |
| Example 14 | 14 | 7 | 5 | 160 | 210 | $5.2 \times 10^5$ | 37 | 98 | 41 | 59 | 39 | 1.2 |
| Example 15 | 15 | 7 | 5 | 160 | 240 | $1.4 \times 10^5$ | 38 | 96 | 43 | 61 | 41 | 1.2 |
| Example 16 | 16 | 8 | 6 | 160 | 190 | $9.2 \times 10^5$ | 50 | 76 | 52 | 84 | 64 | 2.4 |
| Example 17 | 17 | 8 | 6 | 160 | 210 | $6.6 \times 10^5$ | 50 | 76 | 52 | 84 | 64 | 2.4 |
| Example 18 | 18 | 8 | 6 | 160 | 240 | $2.1 \times 10^5$ | 51 | 75 | 53 | 85 | 65 | 2.4 |
| Example 19 | 19 | 8 | 6 | 200 | 240 | $4.6 \times 10^5$ | 54 | 68 | 58 | 90 | 70 | 1.5 |
| Example 20 | 20 | 9 | 7 | 160 | 210 | $6.2 \times 10^5$ | 38 | 104 | 44 | 72 | 52 | 1.4 |
| Example 21 | 21 | 9 | 7 | 180 | 210 | $4.9 \times 10^5$ | 39 | 101 | 45 | 74 | 54 | 1.1 |
| Example 22 | 22 | 9 | 7 | 200 | 210 | $3.5 \times 10^5$ | 40 | 99 | 48 | 77 | 57 | 0.8 |
| Example 23 | 23 | 9 | 7 | 160 | 190 | $7.7 \times 10^5$ | 38 | 104 | 44 | 72 | 52 | 1.4 |
| Example 24 | 24 | 9 | 7 | 160 | 240 | $1.1 \times 10^5$ | 39 | 102 | 45 | 73 | 53 | 1.4 |
| Example 25 | 25 | 10 | 1 | 160 | 210 | $5.5 \times 10^5$ | 44 | 90 | 49 | 72 | 51 | 1.5 |
| Example 26 | 26 | 11 | 1 | 160 | 210 | $9.2 \times 10^5$ | 49 | 80 | 60 | 68 | 55 | 1.5 |
| Comparative Example 1 | C1 | 12 | 8 | 160 | 170 | $8.3 \times 10^5$ | 50 | 105 | 55 | 88 | 60 | 3.5 |
| Comparative Example 2 | C2 | 12 | 8 | 160 | 210 | $5.4 \times 10^5$ | 50 | 105 | 55 | 88 | 60 | 3.5 |
| Comparative Example 3 | C3 | 12 | 8 | 160 | 230 | $2.9 \times 10^5$ | 50 | 105 | 55 | 88 | 60 | 3.5 |
| Comparative Example 4 | C4 | 12 | 8 | 160 | 240 | $1.7 \times 10^5$ | 52 | 101 | 57 | 90 | 63 | 3.5 |
| Comparative Example 5 | C5 | 5 | 3 | 140 | 210 | $8.2 \times 10^5$ | 42 | 80 | 46 | 75 | 60 | 3.3 |
| Comparative Example 6 | C6 | 5 | 3 | 140 | 240 | $5.3 \times 10^5$ | 45 | 82 | 48 | 77 | 61 | 3.3 |

TABLE 7

| No. | Charging member No. | M1 [N/mm$^2$] | M2 [N/mm$^2$] | M1/M2 | S1 [μm$^2$] | S5 [μm$^2$] | S | d1 [μm] | d5 [μm] | d |
|---|---|---|---|---|---|---|---|---|---|---|
| Example 1 | 1 | 2.6 | 1.5 | 0.58 | 132 | 180 | 0.36 | 30.1 | 18.1 | 0.40 |
| Example 2 | 2 | 2.6 | 1.8 | 0.69 | 120 | 164 | 0.37 | 31.0 | 20.5 | 0.34 |
| Example 3 | 3 | 2.7 | 2.2 | 0.81 | 115 | 156 | 0.36 | 32.3 | 25.2 | 0.22 |
| Example 4 | 4 | 2.0 | 1.4 | 0.70 | 160 | 237 | 0.48 | 29.5 | 19.5 | 0.34 |
| Example 5 | 5 | 4.0 | 1.6 | 0.40 | 62 | 76 | 0.22 | 29.5 | 15.9 | 0.46 |
| Example 6 | 6 | 2.6 | 2.0 | 0.77 | 102 | 139 | 0.36 | 29.3 | 19.0 | 0.35 |
| Example 7 | 7 | 2.6 | 1.7 | 0.65 | 187 | 256 | 0.37 | 31.2 | 24.3 | 0.22 |
| Example 8 | 8 | 2.6 | 2.2 | 0.85 | 117 | 159 | 0.36 | 19.7 | 15.6 | 0.21 |
| Example 9 | 9 | 2.6 | 1.4 | 0.54 | 120 | 164 | 0.37 | 53.2 | 30.9 | 0.42 |
| Example10 | 10 | 2.0 | 1.3 | 0.65 | 149 | 221 | 0.48 | 27.8 | 19.2 | 0.31 |
| Example11 | 11 | 2.7 | 1.4 | 0.52 | 122 | 167 | 0.37 | 27.5 | 17.9 | 0.35 |
| Example12 | 12 | 4.0 | 1.5 | 0.38 | 64 | 79 | 0.24 | 28.4 | 16.5 | 0.42 |
| Example13 | 13 | 2.0 | 1.2 | 0.60 | 152 | 228 | 0.50 | 26.6 | 18.9 | 0.29 |
| Example14 | 14 | 2.7 | 1.2 | 0.44 | 126 | 174 | 0.38 | 25.8 | 15.0 | 0.42 |
| Example15 | 15 | 4.0 | 1.3 | 0.33 | 70 | 88 | 0.25 | 27.3 | 13.7 | 0.50 |
| Example16 | 16 | 2.0 | 1.7 | 0.85 | 145 | 210 | 0.45 | 35.9 | 25.8 | 0.28 |
| Example17 | 17 | 2.7 | 2.1 | 0.78 | 105 | 152 | 0.45 | 35.2 | 24.6 | 0.30 |
| Example18 | 18 | 4.0 | 3.0 | 0.75 | 53 | 65 | 0.22 | 36.0 | 25.6 | 0.29 |
| Example19 | 19 | 4.0 | 3.5 | 0.88 | 48 | 58 | 0.21 | 38.8 | 33.0 | 0.15 |
| Example20 | 20 | 2.7 | 1.3 | 0.48 | 125 | 171 | 0.37 | 29.0 | 18.0 | 0.38 |
| Example21 | 21 | 2.6 | 1.6 | 0.62 | 122 | 166 | 0.36 | 29.7 | 20.8 | 0.30 |
| Example22 | 22 | 2.6 | 2.0 | 0.77 | 115 | 156 | 0.36 | 31.0 | 24.5 | 0.21 |
| Example23 | 23 | 2.0 | 1.3 | 0.65 | 151 | 227 | 0.50 | 28.9 | 22.8 | 0.21 |
| Example24 | 24 | 4.0 | 1.4 | 0.35 | 66 | 83 | 0.25 | 26.2 | 13.6 | 0.48 |
| Example25 | 25 | 2.4 | 1.5 | 0.63 | 137 | 188 | 0.37 | 33.3 | 22.3 | 0.33 |
| Example26 | 26 | 2.2 | 1.6 | 0.73 | 143 | 197 | 0.38 | 35.4 | 24.8 | 0.30 |
| Comparative Example 1 | C1 | 1.7 | 1.7 | 1.00 | 173 | 263 | 0.52 | 33.6 | 16.8 | 0.50 |
| Comparative Example 2 | C2 | 2.4 | 2.4 | 1.00 | 110 | 166 | 0.51 | 36.5 | 31.0 | 0.15 |
| Comparative Example 3 | C3 | 2.7 | 2.7 | 1.00 | 99 | 134 | 0.35 | 40.1 | 34.5 | 0.14 |
| Comparative Example 4 | C4 | 3.8 | 3.8 | 1.00 | 59 | 72 | 0.22 | 43.4 | 39.1 | 0.10 |
| Comparative Example 5 | C5 | 2.7 | 1.1 | 0.41 | 120 | 166 | 0.38 | 31.0 | 15.2 | 0.51 |
| Comparative Example 6 | C6 | 4.1 | 1.1 | 0.27 | 86 | 104 | 0.21 | 30.8 | 12.3 | 0.60 |

| | Image evaluation 1 Evaluation for abrasion properties | | | | Image evaluation 2 Evaluation for stain resistance | | | |
|---|---|---|---|---|---|---|---|---|
| No. | 10000 sheets | 20000 sheets | 30000 sheets | 40000 sheets | 10000 sheets | 20000 sheets | 30000 sheets | 40000 sheets |
| Example 1 | 1 | 1 | 1 | 1 | 1 | 1 | 1 | 2 |
| Example 2 | 1 | 1 | 1 | 2 | 1 | 1 | 1 | 2 |
| Example 3 | 1 | 1 | 2 | 2 | 1 | 1 | 1 | 2 |
| Example 4 | 1 | 1 | 1 | 2 | 1 | 1 | 2 | 3 |
| Example 5 | 1 | 1 | 1 | 1 | 1 | 1 | 1 | 1 |
| Example 6 | 1 | 1 | 1 | 2 | 1 | 1 | 1 | 2 |
| Example 7 | 1 | 1 | 2 | 2 | 1 | 1 | 1 | 2 |
| Example 8 | 1 | 1 | 2 | 2 | 1 | 1 | 1 | 2 |
| Example 9 | 1 | 1 | 1 | 1 | 1 | 1 | 1 | 2 |
| Example10 | 1 | 1 | 1 | 2 | 1 | 1 | 2 | 3 |
| Example11 | 1 | 1 | 1 | 2 | 1 | 1 | 1 | 2 |
| Example12 | 1 | 1 | 1 | 1 | 1 | 1 | 1 | 1 |
| Example13 | 1 | 1 | 1 | 2 | 1 | 1 | 2 | 3 |
| Example14 | 1 | 1 | 1 | 2 | 1 | 1 | 1 | 2 |
| Example15 | 1 | 1 | 1 | 1 | 1 | 1 | 1 | 1 |
| Example16 | 1 | 1 | 2 | 2 | 1 | 1 | 2 | 2 |
| Example17 | 1 | 1 | 2 | 2 | 1 | 1 | 2 | 2 |
| Example18 | 1 | 1 | 2 | 3 | 1 | 1 | 1 | 1 |
| Example19 | 1 | 2 | 2 | 3 | 1 | 1 | 1 | 1 |
| Example20 | 1 | 1 | 1 | 2 | 1 | 1 | 1 | 2 |
| Example21 | 1 | 1 | 2 | 2 | 1 | 1 | 1 | 2 |
| Example22 | 1 | 1 | 1 | 2 | 1 | 1 | 1 | 2 |
| Example23 | 1 | 1 | 1 | 2 | 1 | 2 | 2 | 3 |
| Example24 | 1 | 1 | 1 | 1 | 1 | 1 | 1 | 1 |
| Example25 | 1 | 1 | 1 | 2 | 1 | 1 | 1 | 2 |
| Example26 | 1 | 1 | 1 | 2 | 1 | 1 | 1 | 2 |
| Comparative Example 1 | 1 | 1 | 1 | 1 | 2 | 3 | 4 | 4 |

TABLE 7-continued

| | | | | | | | | |
|---|---|---|---|---|---|---|---|---|
| Comparative Example 2 | 1 | 2 | 2 | 3 | 1 | 2 | 3 | 4 |
| Comparative Example 3 | 1 | 2 | 3 | 4 | 1 | 1 | 1 | 2 |
| Comparative Example 4 | 2 | 3 | 4 | 4 | 1 | 1 | 1 | 1 |
| Comparative Example 5 | 1 | 1 | 1 | 2 | 1 | 2 | 3 | 4 |
| Comparative Example 6 | 1 | 1 | 1 | 1 | 2 | 3 | 4 | 4 |

As can be seen from the above, in Examples 1 to 26, since the ratio S of contact area and the ratio d of height of spaces satisfied the formulae (1) and (2), respectively, the abrasion resistance and stain resistance were both satisfactory. On the other hand, in Comparative Examples 1 and 2, the ratio S of contact area was larger than the upper limit of the formula (1), and as a result the stain resistance was poor. In Comparative Examples 3 and 4, the ratio d of height of spaces was lower than the lower limit of the formula (2), and as a result the abrasion resistance was poor. Further, in Comparative Examples 5 and 6, the ratio d of height of spaces was larger than the upper limit of the formula (2), and as a result the stain resistance was poor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-077053, filed Apr. 3, 2015 which is hereby incorporated by reference herein in its entirety.

REFERENCE SIGNS LIST

1 electro-conductive substrate
2 electro-conductive elastic layer
11 bowl-shaped resin particle
12 electro-conductive elastic layer
13 electrophotographic photosensitive member
14 charging member
31 cylindrical metal
32 bearing
33 electro-conductive substrate
34 charging member
35 stabilized power source
36 ammeter
41 bowl-shaped resin particle
42 electro-conductive elastic layer
51 opening portion of bowl-shaped resin particle
52 concavity derived from bowl-shaped resin particle
53 edge of opening of bowl-shaped resin particle
54 height difference
55 maximum diameter of bowl-shaped resin particle
61 opening portion
62 concavity of opening portion
63 minimum diameter of opening portion
71 bowl-shaped resin particle
72 electro-conductive elastic layer
81 stage for setting charging roller capable of moving vertically thereon
82 glass plate
83 stage with glass plate fixed thereon
84 load meter
85 space formed between surface of charging member and glass plate
101 charging roller
102 electrophotographic photosensitive member
103 developing roller
104 transfer roller
105 fixing belt
106 cleaning member
107 exposure light
108 collection container
109 power source for charging

The invention claimed is:

1. A charging member comprising:

an electro-conductive substrate; and an electro-conductive elastic layer as a surface layer on the substrate, wherein the electro-conductive elastic layer comprises a binder, and retains a bowl-shaped resin particle having an opening, so that the opening of the bowl-shaped resin particle is exposed at a surface of the charging member;

the surface of the charging member comprises:

a concavity derived from the opening of the bowl-shaped resin particle exposed at the surface, and a protrusion derived from an edge of the opening of the bowl-shaped resin particle exposed at the surface;

a part of the surface of the charging member is constituted by the electro-conductive elastic layer; and relations represented by the following formulae (1) and (2) are satisfied, $$0.2 \le S = \frac{|S5 - S1|}{S1} \le 0.5 \quad \text{Formula (1)}$$

$$0.15 \le d = \frac{|d5 - d1|}{d1} \le 0.5 \quad \text{Formula (2)}$$

wherein when the charging member is pressed onto a glass plate so that a load on the glass plate is 100 (g), in a contact region R1 comprising at least one contact portion between the charging member and the glass plate in a nip between the charging member and the glass plate, S1 is defined as an average value of contact areas between the charging member and the glass plate in the respective contact portions and d1 is defined as an average value of heights of respective spaces formed between the charging member and the glass plate in the contact region R1; and when the charging member is pressed onto a glass plate so that a load on the glass plate is 500 (g), in a contact region R5 comprising at least one contact portion between the charging member and the glass plate in a nip between the charging member and the glass plate, S5 is defined as an average value of contact areas between the charging member and the glass plate in the respective contact portions and d5 is defined as an average value of heights of respective spaces formed between the charging member and the glass plate in the contact region R5.

2. The charging member according to claim 1, wherein, when

Martens hardness of the binder on the surface of the charging member is defined as M1, and Martens hardness of the binder immediately beneath a bottom of the concavity derived from the opening of the bowl-shaped resin particle on the surface of the charging member is defined as M2, a value of M2/M1 is less than 1.

3. A process cartridge comprising a charging member and an electrophotographic photosensitive member and being configured to be attachable to and detachable from a main body of an electrophotographic apparatus, wherein the charging member comprises:

an electro-conductive substrate; and an electro-conductive elastic layer as a surface layer on the substrate, wherein the electro-conductive elastic layer comprises a binder, and retains a bowl-shaped resin particle having an opening, so that the opening of the bowl-shaped resin particle is exposed at a surface of the charging member;

the surface of the charging member comprises:

a concavity derived from the opening of the bowl-shaped resin particle exposed at the surface, and a protrusion derived from an edge of the opening of the bowl-shaped resin particle exposed at the surface;

a part of the surface of the charging member is constituted by the electro-conductive elastic layer; and relations represented by the following formulae (1) and (2) are satisfied, $$0.2 \le S = \frac{|S5 - S1|}{S1} \le 0.5 \quad \text{Formula (1)}$$

$$0.15 \le d = \frac{|d5 - d1|}{d1} \le 0.5 \quad \text{Formula (2)}$$

wherein when the charging member is pressed onto a glass plate so that a load on the glass plate is 100 (g), in a contact region R1 comprising at least one contact portion between the charging member and the glass plate in a nip between the charging member and the glass plate, S1 is defined as an average value of contact areas between the charging member and the glass plate in the respective contact portions and d1 is defined as an average value of heights of respective spaces formed between the charging member and the glass plate in the contact region R1, and when the charging member is pressed onto a glass plate so that a load on the glass plate is 500 (g), in a contact region R5 comprising at least one contact portion between the charging member and the glass plate in a nip between the charging member and the glass plate, S5 is defined as an average value of contact areas between the charging member and the glass plate in the respective contact portions and d5 is defined as an average value of heights of respective spaces formed between the charging member and the glass plate in the contact region R5.

4. The process cartridge according to claim 3, wherein, when

Martens hardness of the binder on the surface of the charging member is defined as M1, and Martens hardness of the binder immediately beneath a bottom of the concavity derived from the opening of the bowl-shaped resin particle on the surface of the charging member is defined as M2, a value of M2/M1 is less than 1.

5. An electrophotographic apparatus comprising a charging member and an electrophotographic photosensitive member, wherein the charging member comprises:

an electro-conductive substrate; and an electro-conductive elastic layer as a surface layer on the substrate, wherein the electro-conductive elastic layer comprises a binder, and retains a bowl-shaped resin particle having an opening, so that the opening of the bowl-shaped resin particle is exposed at a surface of the charging member;

the surface of the charging member comprises:

a concavity derived from the opening of the bowl-shaped resin particle exposed at the surface, and a protrusion derived from an edge of the opening of the bowl-shaped resin particle exposed at the surface;

a part of the surface of the charging member is constituted by the electro-conductive elastic layer; and relations represented by the following formulae (1) and (2) are satisfied, $$0.2 \le S = \frac{|S5 - S1|}{S1} \le 0.5 \quad \text{Formula (1)}$$

$$0.15 \le d = \frac{|d5 - d1|}{d1} \le 0.5 \quad \text{Formula (2)}$$

wherein when the charging member is pressed onto a glass plate so that a load on the glass plate is 100 (g), in a contact region R1 comprising at least one contact portion between the charging member and the glass plate in a nip between the charging member and the glass plate, S1 is defined as an average value of contact areas between the charging member and the glass plate in the respective contact portions and d1 is defined as an average value of heights of respective spaces formed between the charging member and the glass plate in the contact region R1, and when the charging member is pressed onto a glass plate so that a load on the glass plate is 500 (g), in a contact region R5 comprising at least one contact portion between the charging member and the glass plate in a nip between the charging member and the glass plate, S5 is defined as an average value of contact areas between the charging member and the glass plate in the respective contact portions and d5 is defined as an average value of heights of respective spaces formed between the charging member and the glass plate in the contact region R5.

6. The electrophotographic apparatus according to claim 5, wherein, when Martens hardness of the binder on the surface of the charging member is defined as M1, and Martens hardness of the binder immediately beneath a bottom of the concavity derived from the opening of the bowl-shaped resin particle on the surface of the charging member is defined as M2, a value of M2/M1 is less than 1.

* * * * *